US009282795B2

(12) United States Patent
King et al.

(10) Patent No.: US 9,282,795 B2
(45) Date of Patent: Mar. 15, 2016

(54) RETRACTABLE TABLE FOR LUGGAGE

(75) Inventors: William L. King, Swansea, MA (US); Kyle F. Gendreau, Franklin, MA (US)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 601 days.

(21) Appl. No.: 13/405,057

(22) Filed: Feb. 24, 2012

(65) Prior Publication Data

US 2012/0217109 A1 Aug. 30, 2012

Related U.S. Application Data

(60) Provisional application No. 61/446,341, filed on Feb. 24, 2011.

(51) Int. Cl.

| | |
|---|---|
| ***A45C 9/00*** | (2006.01) |
| *A45C 15/00* | (2006.01) |
| *A45C 13/10* | (2006.01) |

(52) U.S. Cl.

CPC . *A45C 9/00* (2013.01); *A45C 13/10* (2013.01); *A45C 15/00* (2013.01)

(58) Field of Classification Search

CPC ..... A45C 9/00; A45C 15/00; A45C 13/10
USPC ..... 190/9–12 A
See application file for complete search history.

(56) References Cited

U.S. PATENT DOCUMENTS

| | | | | |
|---|---|---|---|---|
| 3,023,923 A | * | 3/1962 | Geib et al. | 220/840 |
| 5,209,384 A | * | 5/1993 | Anderson | 224/580 |
| 5,476,163 A | | 12/1995 | Wu | |
| 5,642,552 A | | 7/1997 | Wang et al. | |
| 5,695,246 A | * | 12/1997 | Tsai | 297/335 |
| 5,779,112 A | * | 7/1998 | Krulik | 224/155 |
| 6,000,509 A | * | 12/1999 | Chisholm | 190/109 |
| 6,062,357 A | * | 5/2000 | Bogert | 190/18 A |
| 6,105,508 A | | 8/2000 | Ryburg | |
| 6,244,484 B1 | * | 6/2001 | Farrell | 224/539 |
| 6,298,964 B1 | * | 10/2001 | Sadow | 190/18 A |
| 6,471,019 B1 | * | 10/2002 | Miller | 190/11 |

(Continued)

FOREIGN PATENT DOCUMENTS

| | | | | |
|---|---|---|---|---|
| JP | 11-290112 | * | 10/1999 | |
| JP | 2000-316619 | * | 11/2000 | |
| JP | 2002-177035 A | * | 6/2002 | A45C 9/00 |

OTHER PUBLICATIONS

Author Unknown, "TriPad Traveler", obtained at url: http://www.gotripad.com/traveler/, known at least as early as Feb. 7, 2012, 2012, 1 page.

*Primary Examiner* — Tri Mai
(74) *Attorney, Agent, or Firm* — Dorsey & Whitney LLP

(57) ABSTRACT

A suitcase may include at least two panels defining a pocket, a substantially planar object sized for receipt within a pocket, at least one guide joined to at least one of the at least two panels, and at least one connection assembly joining the substantially planar object to the at least one guide. The substantially planar object may be a table. The at least one connection assembly and the at least one guide may be configured to allow the at least one connection assembly to move along the guide. The at least one connection assembly may further be configured to allow the table to pivot relative to an outer surface of the suitcase. The table may be supported by an upper outer surface of the suitcase. The table may provide a working surface for a user.

52 Claims, 44 Drawing Sheets

(56) References Cited

U.S. PATENT DOCUMENTS

| | | | | |
|---|---|---|---|---|
| 6,604,472 | B2 | 8/2003 | McNeil | |
| 6,769,588 | B2 * | 8/2004 | Zheng | 224/576 |
| 6,997,507 | B2 * | 2/2006 | Rhee | 297/129 |
| 7,213,692 | B2 * | 5/2007 | Wang et al. | 190/8 |
| 7,593,222 | B2 | 9/2009 | Zbikowski | |
| 7,681,702 | B2 * | 3/2010 | Miyoshi | 190/18 A |
| 8,146,722 | B1 * | 4/2012 | Moreno et al. | 190/18 A |
| 2005/0098402 | A1 | 5/2005 | Cohen | |
| 2007/0089952 | A1 * | 4/2007 | Herbst et al. | 190/8 |
| 2011/0154955 | A1 * | 6/2011 | Fidrych | 81/3.09 |
| 2011/0162931 | A1 * | 7/2011 | Collins et al. | 190/8 |
| 2011/0209960 | A1 * | 9/2011 | MacLean et al. | 190/18 A |
| 2011/0248458 | A1 | 10/2011 | Belanger et al. | |

* cited by examiner

RETRACTABLE TABLE FOR LUGGAGE

CROSS-REFERENCE TO RELATED APPLICATIONS

This application claims the benefit, under 35 U.S.C. §119(e), of U.S. provisional application No. 61/446,341, entitled "Retractable Table for Luggage" and filed on Feb. 24, 2011, which is hereby incorporated in its entirety by reference herein.

TECHNOLOGICAL FIELD

The technical field generally relates to luggage, and more particularly to a working surface for luggage.

BACKGROUND

Luggage, such as suitcases, is often used by travelers or other users to transport items. While using the luggage, the traveler or other user may require use of a flat or otherwise planar surface. Such a planar surface may be needed to support other objects, such as computers, writing pads, containers, dishes, and so on, or to provide a working surface for the user. Often, especially in airports or train stations, it may be difficult to find a suitable flat surface. Accordingly, a ready to use flat or otherwise planar object that could be transported with the luggage may be a useful accessory for a user of the luggage.

SUMMARY

One embodiment of a suitcase may include at least two panels defining a pocket, a substantially planar object sized for receipt within a pocket, at least one guide joined to at least one of the at least two panels, and at least one connection assembly joining the substantially planar object to the at least one guide. The at least one connection assembly and the at least one guide may be configured to allow the at least one connection assembly to move along the guide. The at least one connection assembly may further be configured to allow the substantially planar object to pivot relative to an outer surface of the suitcase.

Another embodiment of a suitcase may include at least one outer panel, a substantially planar object, at least one guide joined to at least one of the at least one outer panel, at least one connection assembly joining the substantially planar object to the at least one guide, and a support mechanism joined to the least one outer panel. The at least one connection assembly and the at least one guide may be configured to allow the at least one connection assembly to move along the guide. The at least one connection assembly may be configured to allow the substantially planar object to pivot relative to an outer surface of the suitcase. The support mechanism and the at least one outer panel may be configured to maintain the substantially planar object in a desired position relative to the at least one outer panel.

Yet another embodiment of a suitcase may include at least two panels defining a pocket, a substantially planar object sized for receipt within a pocket, and at least one guide joined to at least one of the at least two panels. The substantially planar object may include at least one slot. The at least one guide may be received through the at least one slot. The at least one slot and the at least one guide may be configured to allow the substantially planar object to slide along the at least one guide and to pivot relative to an outer surface of the suitcase.

DETAILED DESCRIPTION

Described herein are tables or other substantially planar objects for use with a suitcase or other types of luggage. The tables may be sized for receipt within a pocket or other selectively enclosed space of the suitcase. The tables may be temporarily or permanently joined to the suitcase. The tables may be selectively removed from the pocket and positioned to rest on an outer surface of the suitcase. When supported on the suitcase, the tables may be positioned for supporting other objects, such as a computer, a writing pad or a plate. The tables may further provide a working or eating surface when supported on the outer surface of the suitcase.

Figure 1:
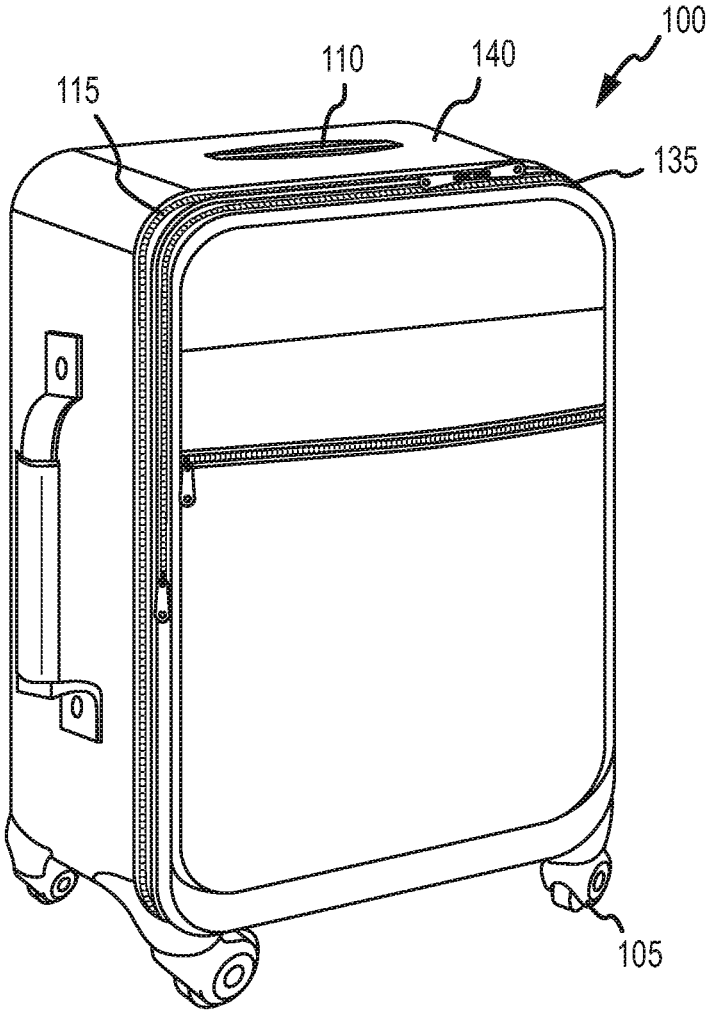
FIG. 1 shows a perspective schematic view of a suitcase.
Figure 2:
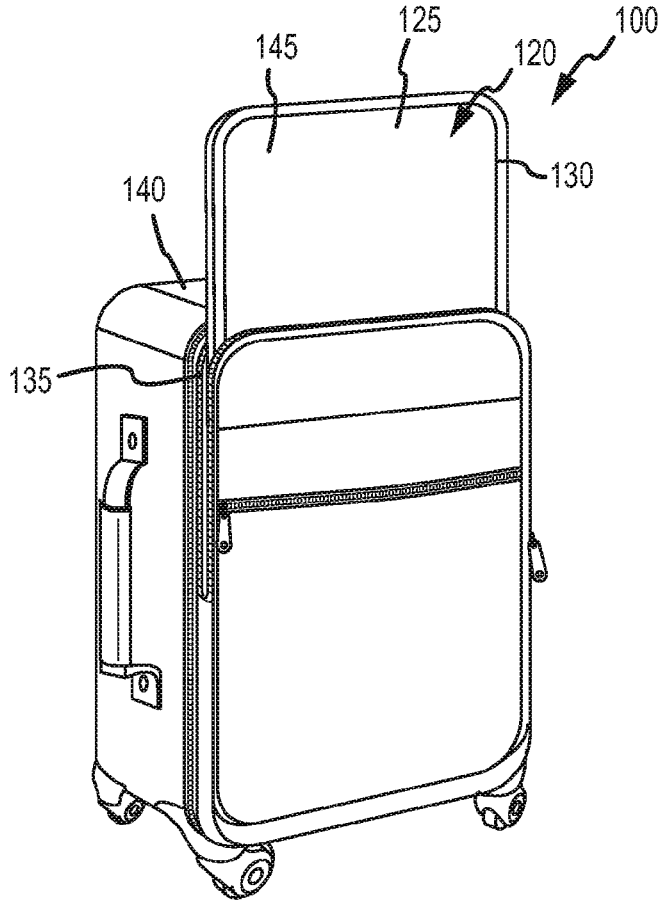
FIG. 2 shows another perspective schematic view of the suitcase of FIG. 1, showing a table partially removed from a pocket.
Figure 3:
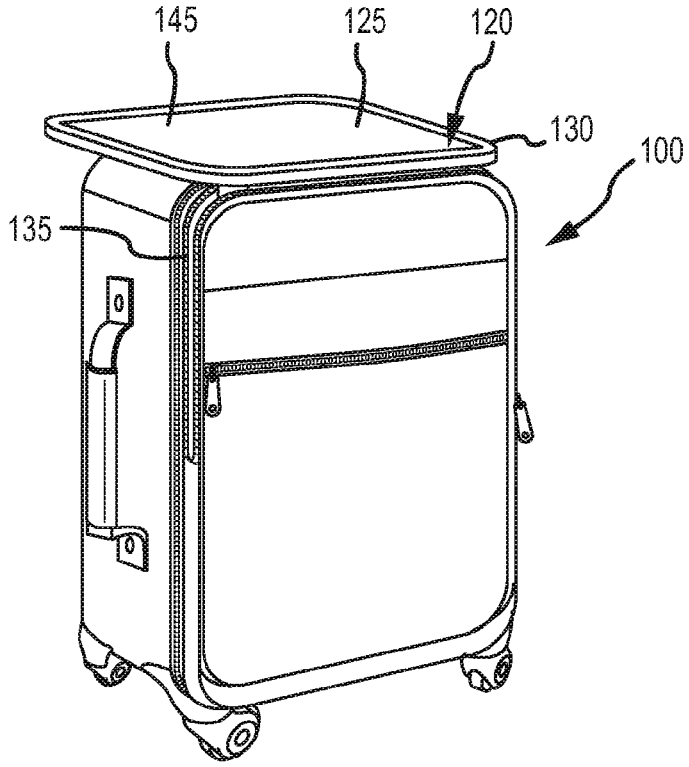
FIG. 3 shows another perspective schematic view of the suitcase of FIG. 1, showing the table positioned on an upper outer surface of the suitcase.
Figure 4:
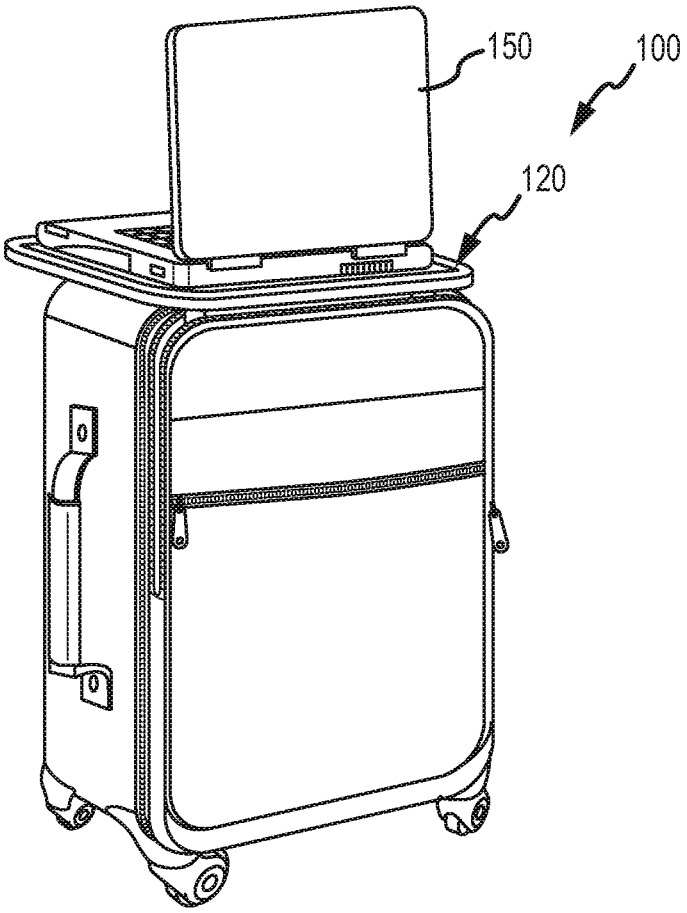
FIG. 4 shows a view similar to FIG. 3, showing a computer positioned on the table.
Figure 5A:
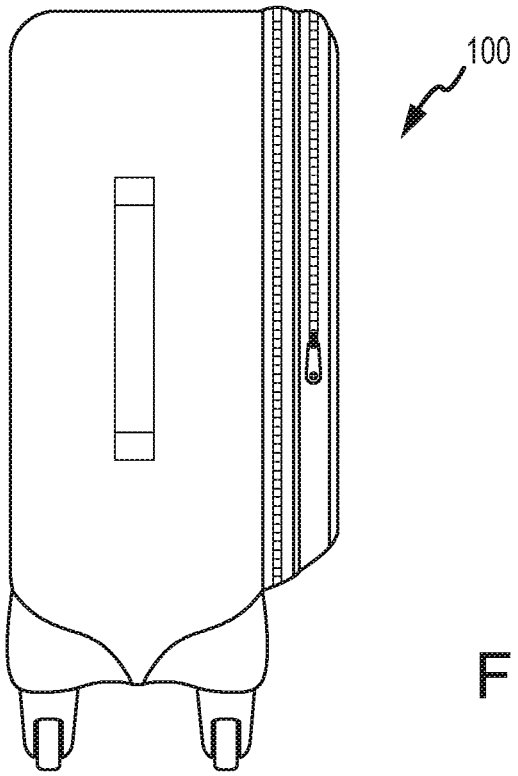
FIG. 5A shows a side elevation schematic view of the suitcase of FIG. 1, showing the suitcase prior to removing the table from its pocket.
Figure 5B:
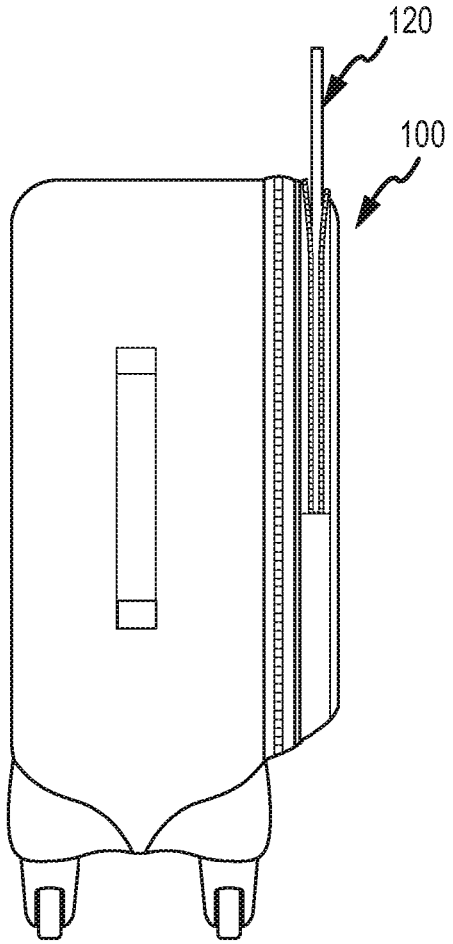
FIG. 5B shows a side elevation schematic view of the suitcase of FIG. 1, showing the table partially removed from its pocket.
Figure 5C:
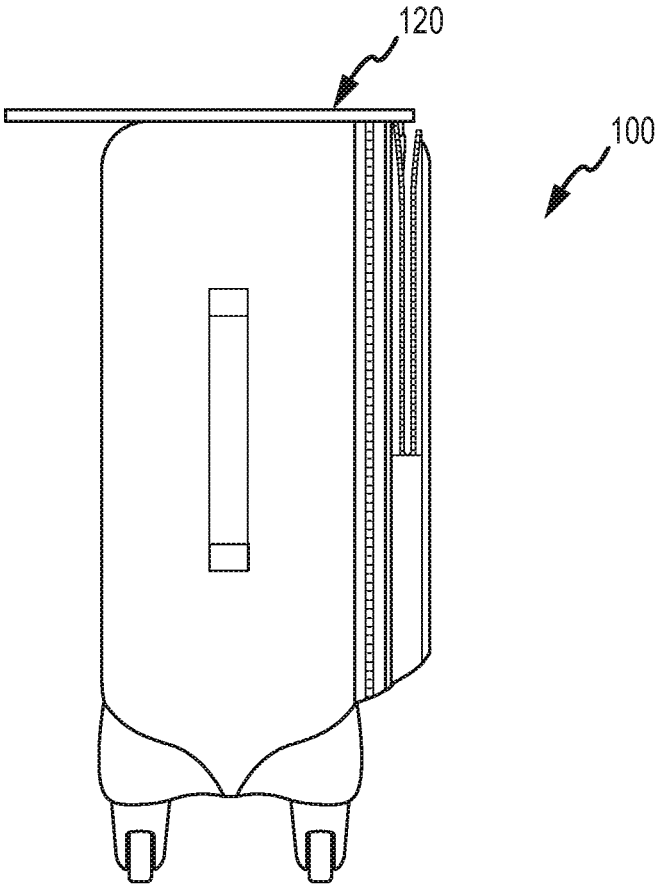
FIG. 5C shows a side elevation schematic view of the suitcase of FIG. 1, showing the table positioned on the upper outer surface of the suitcase.

FIG. 1 shows a perspective schematic view of a suitcase. FIGS. 2-4 show additional perspective schematic views of the suitcase of FIG. 1, with a table shown in various positions relative to the suitcase. FIGS. 5A-C show side elevation schematic views of the suitcase, with the table shown in various positions relative to the suitcase. With reference to FIGS. 1-5C, the suitcase 100 may include multiple panels. The panels (e.g., top, bottom, left, right, front and back panels) may define a main enclosed space. The panels may also define one or more pockets or secondary or supplemental enclosed spaces. Each panel that defines the main enclosed space may have a generally rectangular shape to form a generally parallelepiped suitcase. In some embodiments, the panels may have other shapes to define a suitcase with a desired shape other than generally parallelepiped. The panels may be formed from any type of material or construction used to form a suitcase, including, but not limited to, fabrics (e.g., nylon), plastics (e.g., acrylonitrile butadiene styrene ("ABS"), polycarbonate, polypropylene, polyethylene, etc.), natural materials (e.g., plywood), metals, or some combination thereof.

The suitcase 100 may further include structures, such as lining or internal panels, positioned within the main enclosed space that divide the main enclosed space into two or more compartments. The suitcase may also include any of the following: two or more wheels 105 for moving the suitcase 100 along a support surface, one or more carry handles 110 to lift or otherwise move the suitcase 100, a telescoping handle to facilitate moving the suitcase along the support surface via the wheels 105, edge piping to help protect the outer surface of the suitcase 100 from scuffs and abrasions, and at least one perimeter zipper 115 to access the main enclosed space and any pockets or secondary or supplemental enclosed spaces.

With continued reference to FIGS. 2-5C, the suitcase 100 may include a table 120 or other substantially planar object. The table 120 may include a primary body 125, which may also be referred to herein as a main body. The primary body 125 of the table 120 may be formed using a relatively rigid material, such ABS plastic or the like, wood, or any other suitable material, and may include upper and lower generally planar surfaces. These upper and lower planar surfaces may be generally rectangular or any other desired shape and may be generally similar in size. The upper and lower planar surfaces may be separated a predetermined distance. This predetermined distance may generally define a thickness of the table 120. A softer or shock-absorbing material 130, such as rubber to the like, may be joined to the primary body. This softer or shock-absorbing material 130 may be positioned along at least a portion, up to the entire portion, of the perimeter edge of the primary body 125.

The table 120 may be positioned within a pocket. In some embodiments, the pocket may be defined by at least a portion of an outer panel (e.g., the front panel) of the suitcase 100 and at least a portion of one or more inner panels or structures of the suitcase 100. In other embodiments, the pocket may be defined by two or more inner panels or structures of the suitcase 100. The pocket may be accessed via a zipper 135 or other like mechanism that extends around at least a portion of the pocket's perimeter. The pocket may be sized to be sufficiently large to contain the entire table 120 within the pocket.

The table 120 may be selectively removed from the pocket and positioned to rest on an upper outer surface 140, which may also be referred to as a first outer surface, of the suitcase 100. When positioned in this resting or operational configuration, the upper planar surface 145 of the table 120 may be substantially parallel to the planar outer upper surface 140 of the suitcase 100. Further, a computer 150, a writing pad, a dish, a container, or other objects may be placed on the table 120 when the table 120 is positioned in the resting or operational configuration. In some embodiments, the suitcase 100 may include a carry handle 110 or other handles on the upper outer surface. In such embodiments, the handles 110 may be configured so that the tops of the handles 110 are substantially flush with the upper outer surface 140 to facilitate stabilizing the table 120 when placed on the upper outer surface 140.

In other embodiments, the handles 110 may extend above the upper outer surface 140. In these other embodiments, to help stabilize the table 120 when rested on the upper outer surface 140 of the suitcase 100, the table 120 may include one or more recesses in its lower planar surface to receive the handles 110 therein if the table 120 has sufficient thickness, the table may include a hole that allows at least a portion of the handle 110 to extend through the table and above the outer surface 145 of the table 120, or the table 120 may include additional supports that fold down from the lower planar surface of the table 120 and are configured to be at least as long as the height of the handle 110 above the upper outer surface 140 of the suitcase 100 and to engage the upper outer surface 140 of the suitcase 100. As an example and with reference to FIG. 7B, the table 120 may include a handle recess 155. The handle recess 155 may define a recessed area in the lower planar surface 160 of the table 120. The recessed are may have a depth that is a predetermined ratio of the thickness of the table 120. In some embodiments, the ratio may be approximately one-half of the table thickness. As an example, if the table thickness was approximately ½" then the recess depth may be approximately ¼". In this example, the carry handle 110 may then extend above the upper outer surface 140 of the suitcase 110 up to a ¼", if desired. Of course, these numbers and ratios are merely illustrative of one possible depth for a handle recess 155 that is defined by the lower surface 160 of the table 120. As another example, the table 120 may include a hole that extends from upper surface 145 to the lower surface 160 of the table 120. In this example, the handle 110 may extend through the hole such that at least a portion of the handle 110 extends above the outer surface 145 of the table 120. A computer 150 or the like could then bridge over the portion of the handle 110 that extends above the upper surface 145 of the table 120.

The planar area of the upper and lower surfaces 145, 160 of the table 120 may be greater than an area defined by the upper outer surface 140 of the suitcase 100 that supports the table 120. As such, a portion of the table 120 may extend beyond the suitcase 100 when the table 120 is positioned in its operational configuration. In such an embodiment, the table 120 may thus cantilever from the suitcase 100 in its operational configuration as shown, for example, in FIG. 5C. In some cases, the cantilever may be approximately one-third of the length of the table 120. However, a wide range of ratios for the amount of the table 120 cantilevered to the length of the table 120 is contemplated for the table 120. In other embodiments, the planar area of the upper and lower surfaces 145, 160 of the table 120 may be sized to be no greater than an area defined by the upper outer surface 140 of the suitcase 100 that is available to support the table 120. In these embodiments, the table 120 may be fully supported by the upper outer surface 140 of the suitcase 100 so that no portion of the table 120 extends beyond the suitcase 100 when the table 120 is placed in its operational position.

Figure 6:
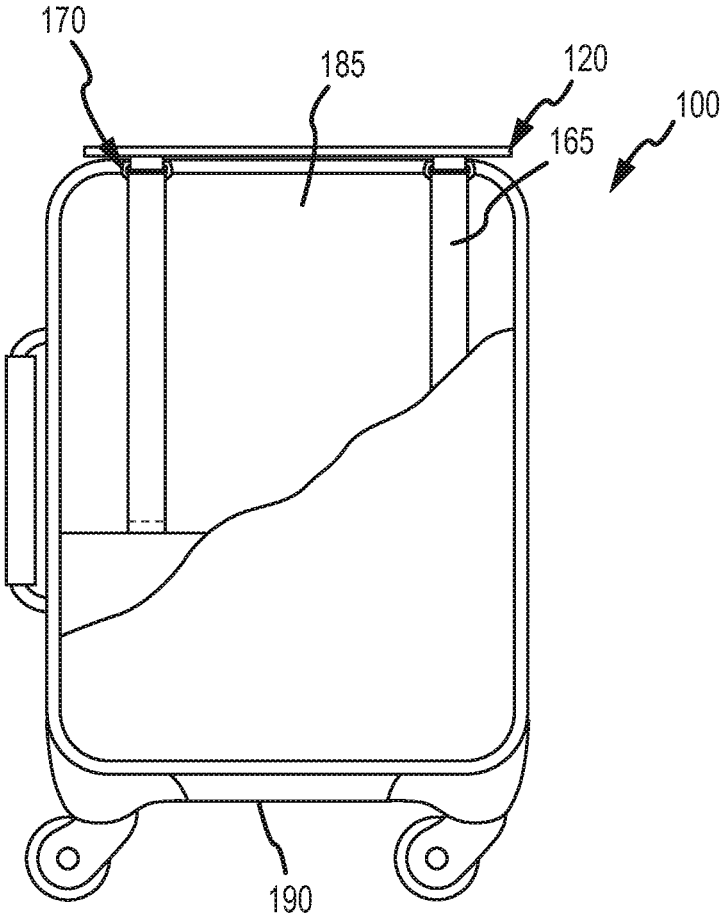
FIG. 6 shows a front elevation schematic view of the suitcase of FIG. 1, with portions of the front outer panel and any intervening interior panels of the suitcase removed to show guides for use with the table.
Figure 7A:
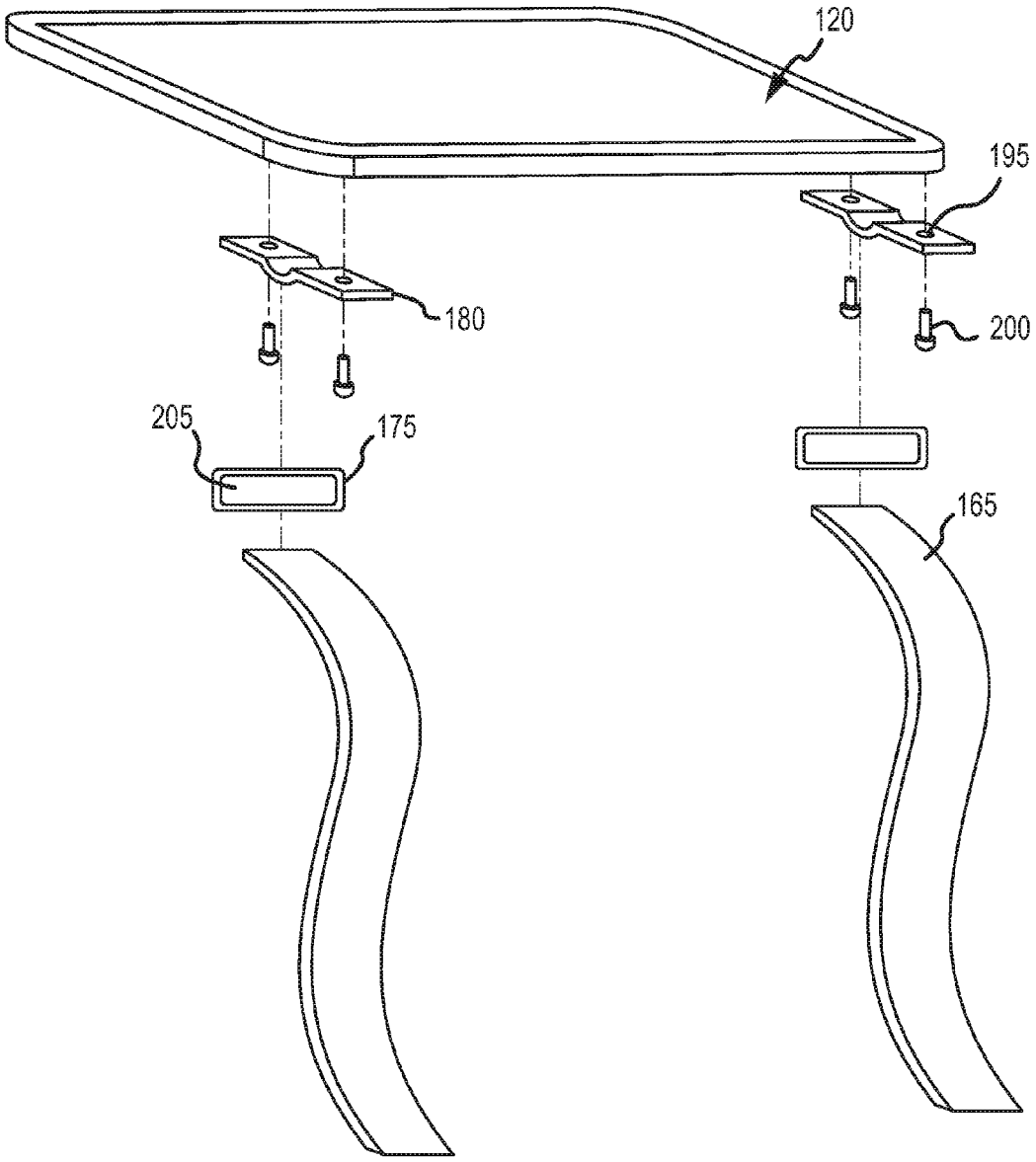
FIG. 7A shows an exploded top perspective view of the table and components used to movably join the table to the suitcase of FIG. 1.
Figure 7B:
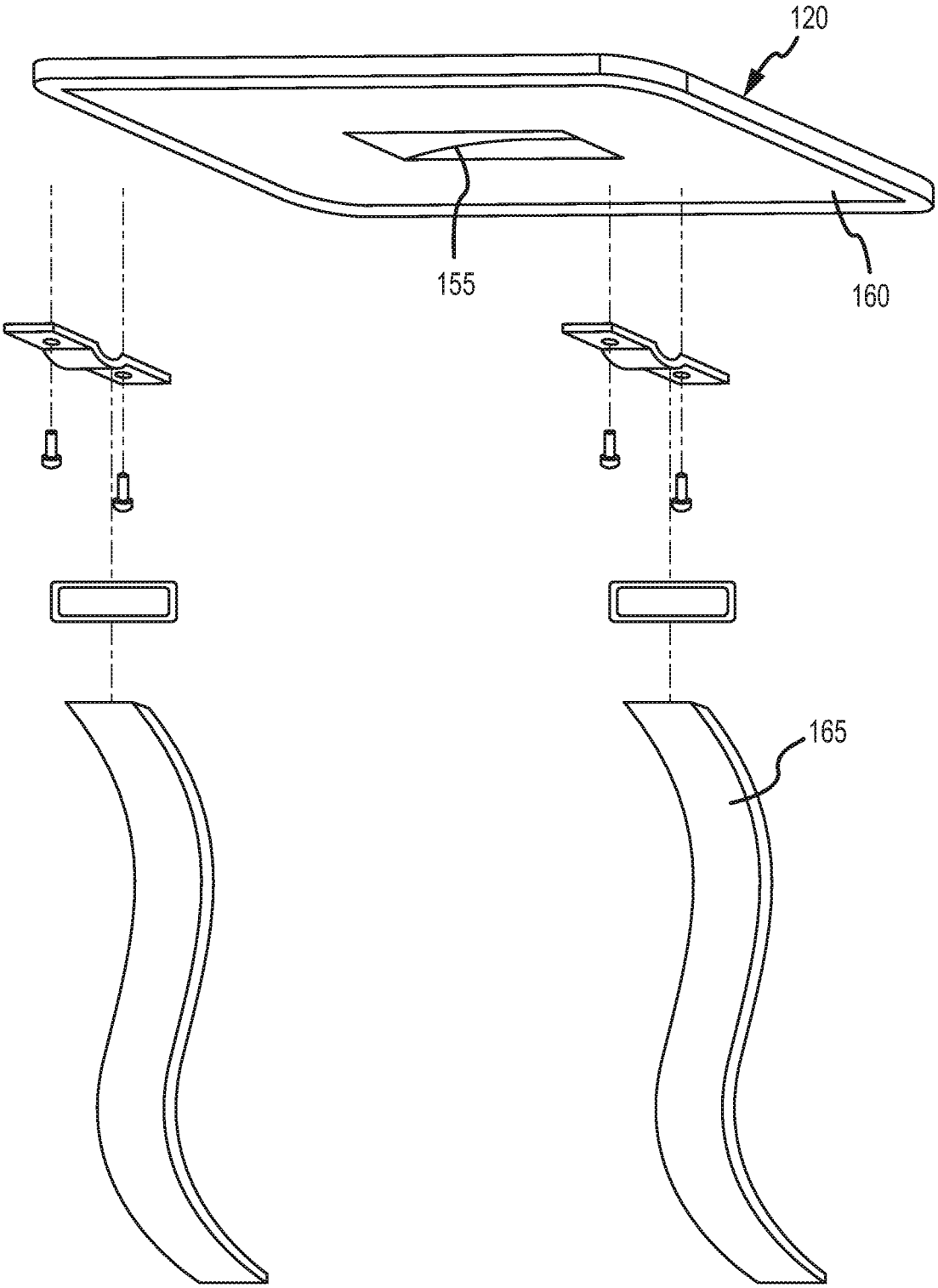
FIG. 7B shows an exploded bottom perspective view of the table and components used to movably join the table to the suitcase of FIG. 1.

FIG. 6 shows a front elevation view of the suitcase 100 with the outer panel and any intervening inner panels removed to show one possible way to movably join the table 120 to the suitcase 100. FIGS. 7A and 7B show exploded perspective views of the table 120 and some components that may be used to movably join the table 120 to the suitcase 100. The components may include one or more guides 165 and one or more connection assemblies 170. Each connection assembly 170 may include a first connector 175 and second connector 180. The guides 165 may be joined to the suitcase 100, and the first and second connectors 175, 180 may be configured to allow the table 120 to slide along the guides 165 and to pivot relative to the suitcase 100. In some embodiments, the first and second connectors 175, 180 may further be configured to keep the table 120 secured to the guides 165. In other embodiments, the first and second connectors 175, 180 may be configured to allow the table 120 to be selectively disconnected from the guides 165.

With reference to FIGS. 6, 7A and 7B, the one or more guides 165 may be joined to one of the panels of the suitcase 100. For the embodiment shown in FIGS. 6, 7A, and 7B, two guides 165 are joined to an interior panel 185. While two guides 165 are shown, more or less than two guides 165 may be used. Also, while the guides 165 are shown as joined to an interior panel 185, the guides could be joined to an exterior panel or any other panel that defines the pocket that receives the table 120. Yet further, while the following paragraphs are focused on the embodiment that uses two guides 165, this discussion would generally apply to suitcases that use any number of guides 165.

The two guides 165 may be spaced apart from each other at a predetermined distance. In some embodiments, the predetermined distance may less than the width of the table 120, such as shown in FIG. 6. In other embodiments, the predetermined distance may be approximately the same width of the table 120 or may be greater than the width of the table. Each guide 165 may be joined to the panel 185 at an end portion that is proximate the upper outer surface 140, or first outer surface, of the suitcase 100 and extend vertically downward towards a lower outer surface 190, which may also be referred to as a second outer surface, of the suitcase 100. The lower outer surface 190, or second outer surface, may be generally distal from the upper or first outer surface 140. Each guide 165 may extend towards the lower or second outer surface 190 of the suitcase 100 at least far enough so that each guide 165 is longer than the length of the table 120. At their respective end portions distal from the upper outer surface 140 of the suitcase 100, each guide 165 may also be joined to the panel 185. While the guides 165 are shown as not extending to the bottom of the suitcase 100, in some embodiments one or more of the guides 165 may extend to the bottom of the suitcase 100.

Each guide 165 may be joined to a respective panel 185 proximate the guide's end portions by mechanical fasteners (e.g., stitches, rivets, snaps and so on), adhesives, welds or any other known connection mechanism. These connections at the end portions of the guides 165 may function as stops to limit movement to the table relative to each guide 165. In particular, the connection at the upper end of the each guide 165 may function to limit further upward sliding of the table 120 as the connection assembly 170 approaches the upper surface 140 of the suitcase 100. Similarly, the connection at the lower end of each guide 165 may function to limit further downward sliding of the table 120 as the connection assembly 170 approaches the lower portion of the pocket. In some embodiments, the pocket may be much deeper than the length of the table 120. In these embodiments, the lower connection of the guide 165 to a respective panel 185 may further function to keep the table from settling to the bottom of the pocket.

Each guide 165 made be formed from a fabric (e.g., nylon), metal (e.g., a light gauge steel strip), a plastic (e.g., ABS or polycarbonate plastic), an elastomer (e.g., rubber), or any other suitable material. Each guide 165 may be generally elongated. In other words, each guide 165 may have a length that is significantly greater than its width or thickness. In some embodiments, each guide 165 may have a generally rectangular cross-section area along the length of the guide. However, the guides 165 may be any suitable shape that allows for the table 120 to be moved along the guides 165 via a connection assembly 170.

While only one of the connection assemblies 170 will be described, the following description would apply to any of the connection assemblies 170. Further, while only two connection assemblies 170 are shown, the number of connection assemblies 170 would generally match the number of guides 165. With continued reference to FIGS. 6, 7A, and 7B, the first connector 175 may be pivotally joined to the table 120 using the second connector 180. The first and second connectors 175, 180 may be formed from metals, plastics, elastomers or any suitable material. The first connector 175 may be a rectangular ring, D-ring or other closed loop or ring structure, and the second connector 180 may be a bracket or the like. The bracket may include two substantially planar end portions joined by an arched or U-shaped section. Each planar end portion of the bracket may include at least one aperture 195 to receive a bracket fastener 200 therethrough to join to the bracket to the table 120. The bracket fastener 200 may be a screw, a rivet or any other suitable mechanical fastener. In some embodiments, the apertures 195 may be omitted, and the bracket may be joined by another connection mechanism, such as adhering or welding. In yet other embodiments, the apertures 195 may be included but the bracket fasteners 200 may be omitted. In such embodiments, the bracket may be joined to the table 120 by any suitable connection mechanism, such as adhering or welding.

When joined to the table 120, the arched shaped section of the bracket and the lower surface 160 of the table 120 may define a connector hole for receiving at least a portion of the first connector 175 therethrough. When the first connector 175 is a rectangular ring, one of the longer edges of the rectangular ring may be received within the connector hole. When the first connector 175 is a D-ring, the straight portion of the D-ring may be received within the connector hole. For other types of closed loops or rings, any portion of the loop or ring may be received within the connector hole.

The first connector 175 may be slidably or otherwise movably joined to one of the guides 165. When the first connector 175 is a rectangular ring, D-ring or other loop or ring-like structure, the first connector 175 may be movably joined to its respective guide 165 by passing the guide 165 through a first connector hole 205 defined by the first connector 175. For example, when the first connector 175 is a rectangular ring, the ring may include four sides (two short sides and two long sides) that define a generally rectangular first connector hole 205. As another example, when the first connector 175 is a D-ring, the D-ring may include a relatively straight portion and an arcuate or curved portion that extends from one end of the straight portion to a distal end of the straight portion. Together, the straight portion and the arcuate or curved portion define the first connector hole 205.

When the guide 165 is passed through the first connector hole 205, at least a portion of the first connector 175 may be positioned between the panel 185 and the guide 165. The first connector 175 may further be positioned between the end portions of the guide 165. In this configuration, the first connector 175 is prevented from being disconnected from the guide 165 once both end portions of the guide 165 are joined to a respective panel 185 by a relatively permanent connection method, such as stitching, gluing or welding. The table 120, in turn, is secured to the first connector 175 via the second connector 180. Since the table 120 is secured to the first connector 175, the table 120 is thus secured to the guide 165.

In some embodiments, the table 120 may be selectively disconnected from the guides 165. For example, if snap fasteners, or any other fastener that allows for the guides 165 to be selectively disconnected from their respective panel 185, are used to join the guides 165 to their respective panel 185, the guides 165 may be released from their respective panel 185 at least at the ends joined by the snap fasteners, or other releasable fastener mechanism. The guides 165 may then be removed from their respective first connector holes 205, thus allowing the first connectors 175 to be disconnected from the guides 165. With the first connectors 175 disconnected from the guides 165, the table 120, in turn, is disconnected from the guides 165. The table 120 may then be selectively rejoined to the guides 165 by passing the guides 165 through the first connector holes 205 of their respective first connectors 175, and rejoining the guides 165 to their respective panel 185 via the snap fasteners, or any other fastener mechanism that allows the guides 185 to be selectively connected to and disconnected from their respective panel 185.

With the first connector 175 joined its respective guide 165 and positioned between the guide's end portions, the first connector 175 may be slid along the guide 165 between the guide's end portions when the closure mechanism (e.g., a zipper) associated with the pocket containing the table 120 is positioned to allow access to the pocket. As the first connectors 175 are slid along a respective guide 165, the table 120 moves along the guides 165. When the first connectors 175 are moved to the end portions of their respective guides proximate the upper outer surface 140 of the suitcase 100, the table 120 is removed from its respective pocket. Once at this location, the table 120 may be pivoted relative to the suitcase 100 until at least a portion of its lower surface 160 rests on the upper outer surface 140 of the suitcase 100, as shown in FIG. 6, among other figures.

To return the suitcase 100 to its pocket, the table 120 may be pivoted until its planar upper and lower surfaces 145, 160 are substantially vertical, or otherwise aligned with the lengths of its respective guides 165. The first connecters 175 may then be slid along a respective guide 165 towards the lower outer surface 190 of the suitcase 100, thus placing the table 120 within its respective pocket. In some embodiments, when the first connector 120 is positioned proximate the end portion of the guide distal the end portion proximate the upper outer surface 140 of the suitcase 100, the table 120 is positioned completely in its respective pocket. Once the table 120 is completely received within its respective pocket, the closure mechanism (e.g., a zipper) may be used to limit access to the pocket, and thus prevent removal of the table 120 from the pocket.

Figure 8B:
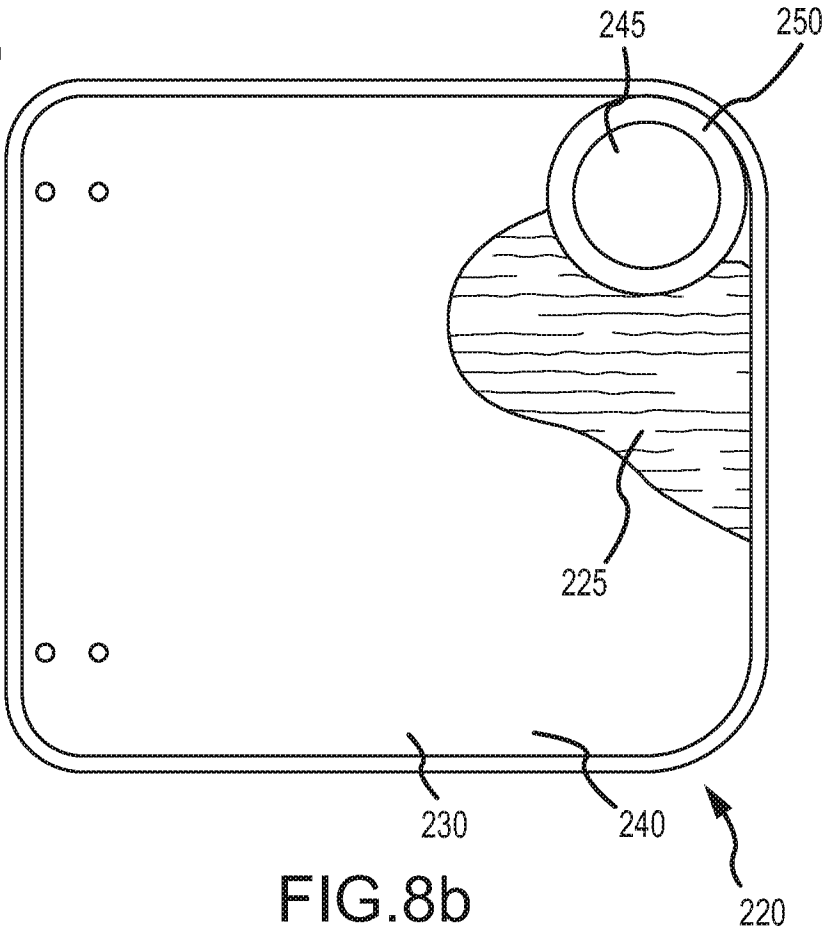
FIG. 8B shows a top view of the table shown in FIG. 8B.
Figure 8A:
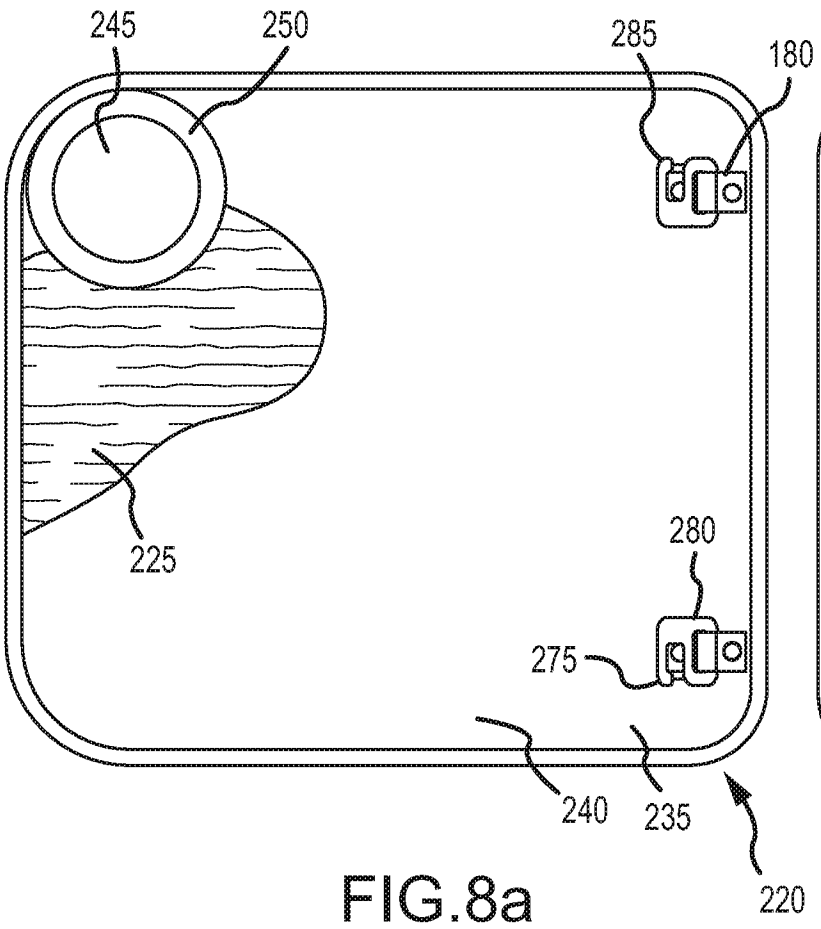
FIG. 8A shows a bottom view of a second version of the table.

FIGS. 8A and 8B show another embodiment of the table 220 and the first connector 275. The second embodiment of the table 220 differs from the table 120 in the first embodiment in that wood panels 225 may be joined to the upper and lower surfaces 230, 235 of a main body 240 of the table 22. The wood panels 225 may be positioned over substantially the entire upper and lower surfaces 230, 235 of the primary or main body 240 to give the table 220 a wood-like appearance. The second embodiment of the table 220 also differs from the first table 120 as the main body 240 of the table 220 includes a hole 245 for receiving a circular or cylindrical container therethrough. A rubber or other elastomeric material 250 may be positioned along the perimeter of the hole 245. This elastomeric material 250 may be sized to define a hole with a diameter that is slightly smaller than the diameter of a preselected circular, cylindrical or other suitably shaped container. The elastomeric material 250 may further be configured to expand slightly radially outward as such a container is placed through the hole 245 in the table 220. The elastomeric material 250 may further be configured so that as it expands radially outward, it seeks to return to its original shape, thus frictionally gripping the container to retain the container within the hole 245 absent the application of a sufficient external force (e.g., a user pulling or pushing on the container) to remove the container from the hole 245. If desired, either the wood panels 225 or the hole 245 may be omitted from the second embodiment of the table 220.

With continued reference to FIG. 8B, the second embodiment of the first connector 275 may include a connector body 280. The connector body 280 may define a first connector hole. The second connector 180 may be positioned through the first connector hole and joined to the table 220 to pivotally join the first connector 275 to the table 220. The connector body 280 may further define an opened end slot proximate the first connector hole. The open ended slot may receive a respective guide 165 therein to movably join the first connector 275 to the guide 165. The open end slot allows the first connector 275 to be readily joined to, and removed from, the guide 165, thus allowing the table 220 to be readily joined to, and disconnected from, the guide 165. Proximate the opening to the opening ended slot, the connector body 280 may include a hook portion 285 that results in the opening to the slot having a smaller width than the width of the slot. This hook portion 285 may help to minimize unintended or inadvertent disconnection of the first connector 275 from its guide 165. The second embodiment of the first connector 275, like the first embodiment of the first connector 175, allows the table 220 to be placed into, and removed from, the pocket by sliding the first connectors 275 along their respective guide 165 and also allows the table 220, when joined to the guides 165, to be pivoted relative to the suitcase 100.

Figure 9A:
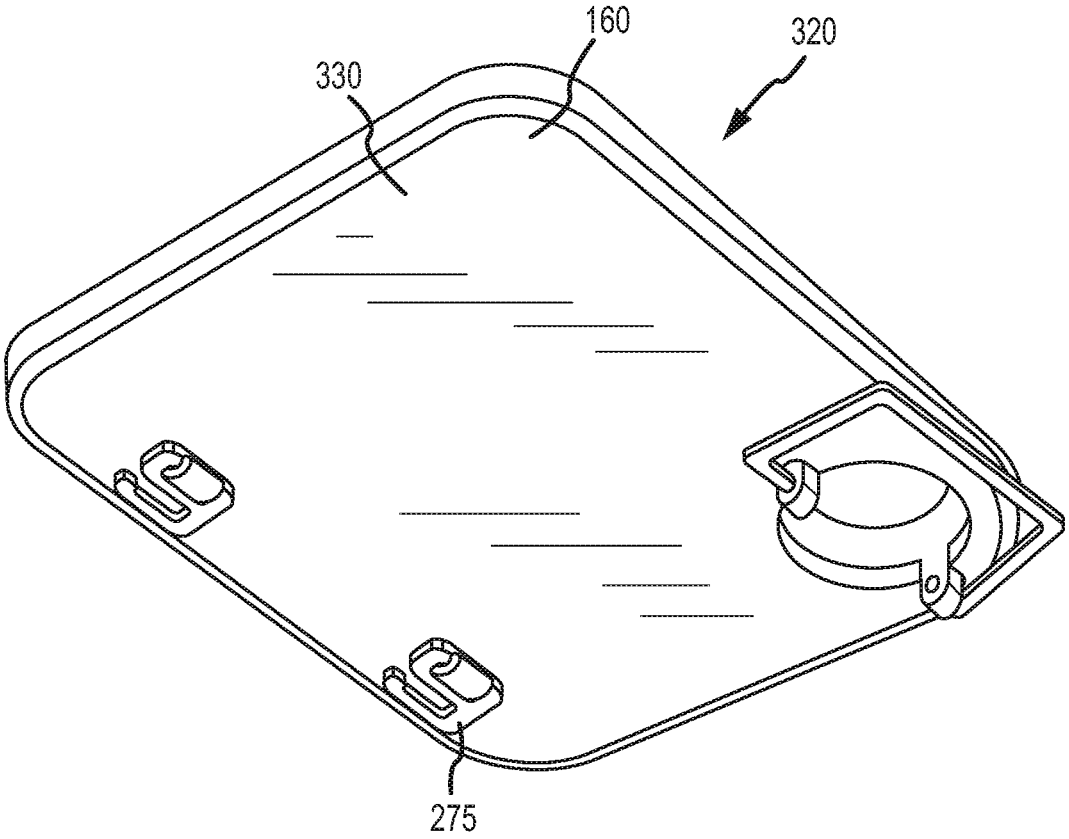
FIG. 9A shows a bottom perspective view of a third version of the table.
Figure 9B:
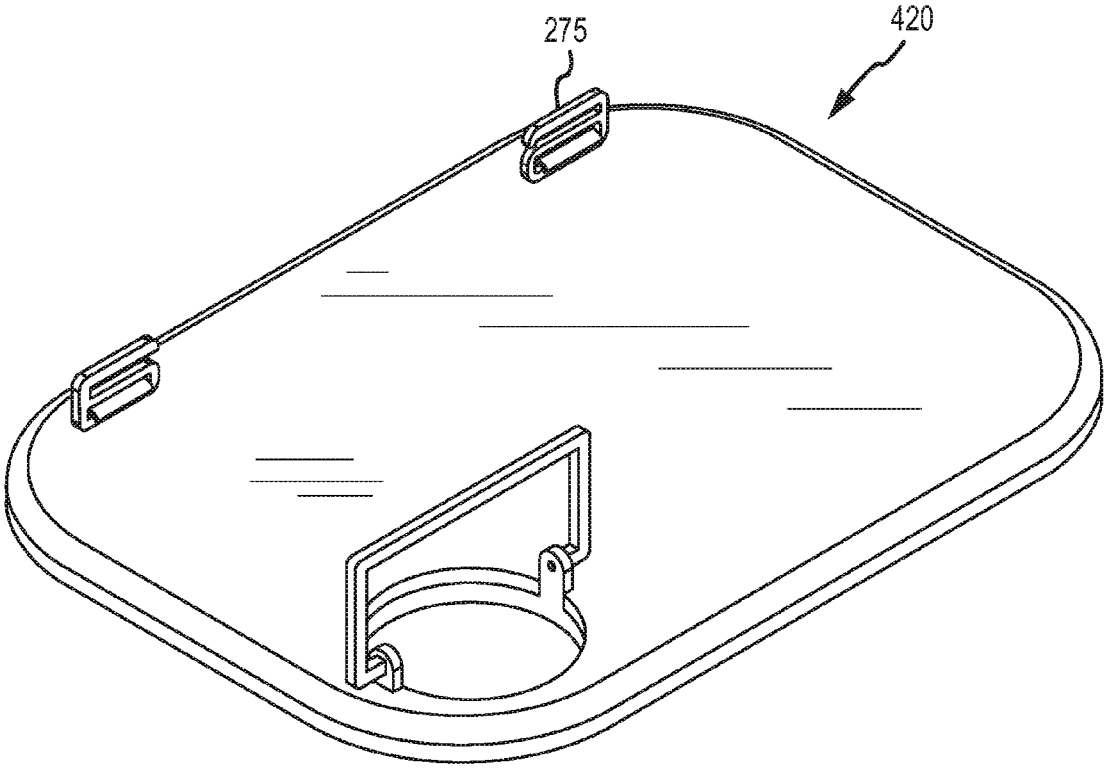
FIG. 9B shows a bottom perspective view of a fourth version of the table.
Figure 10:
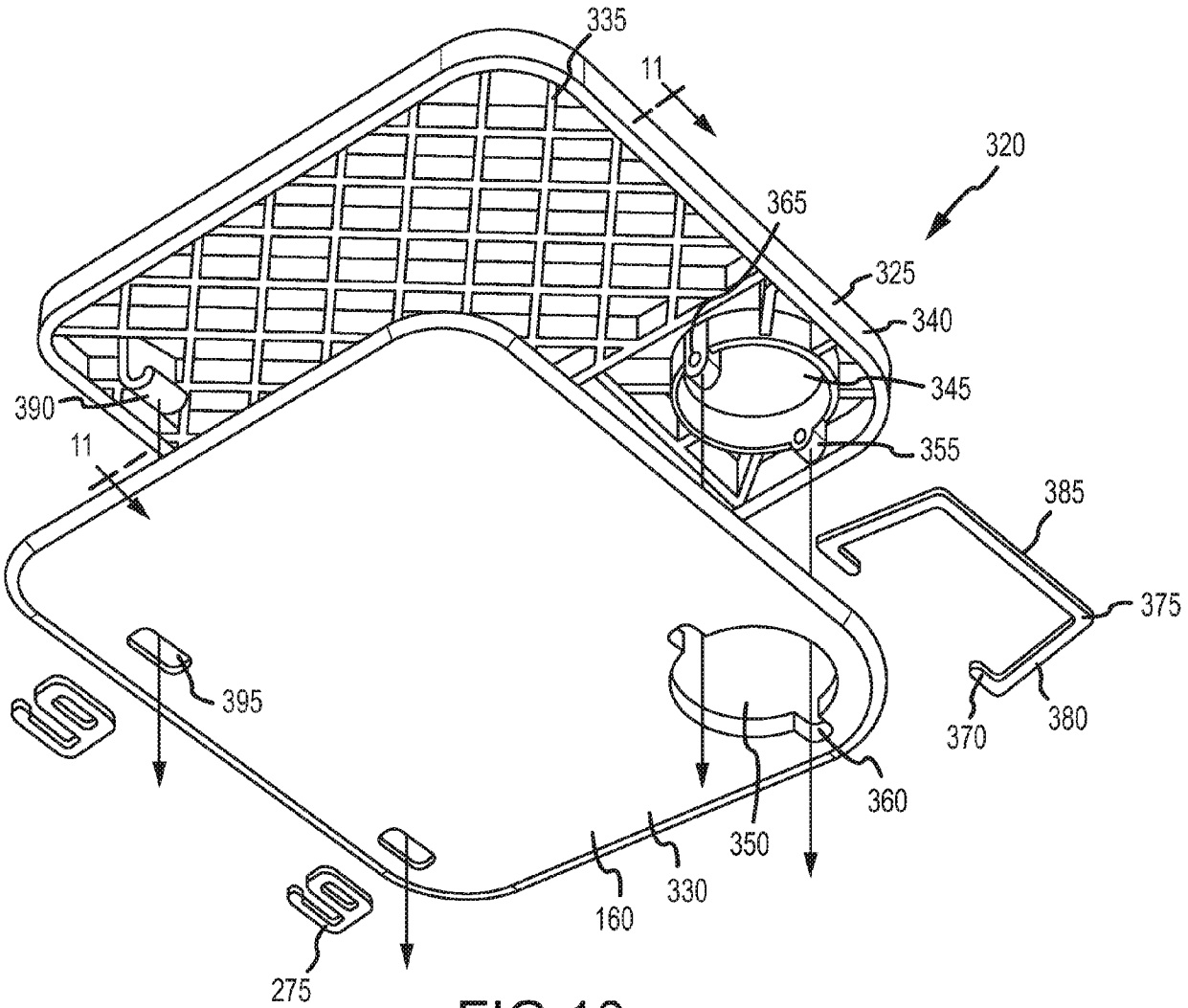
FIG. 10 shows an exploded view of the table shown in FIG. 9A.
Figure 11:
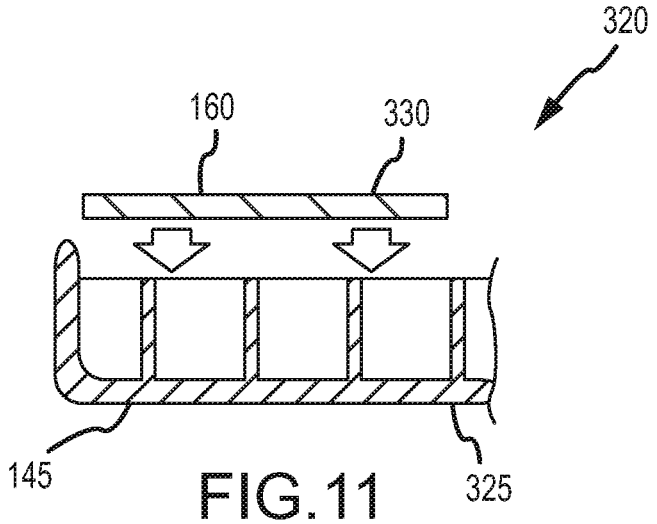
FIG. 11 shows a partial cross-section view of the table shown in FIG. 9A, viewed along line 11-11 in FIG. 10.
Figure 12A:
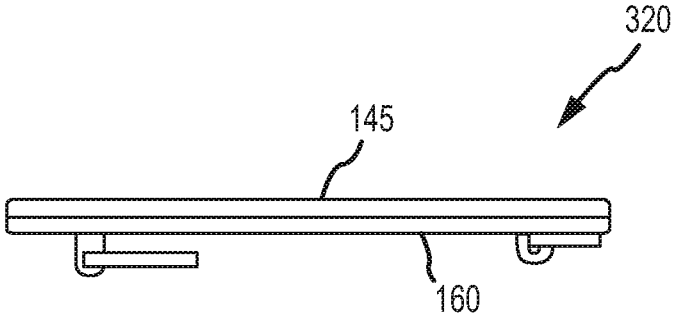
FIG. 12A shows a side elevation view of the table shown in FIG. 9A, showing a lower container support in a horizontal position.
Figure 12B:
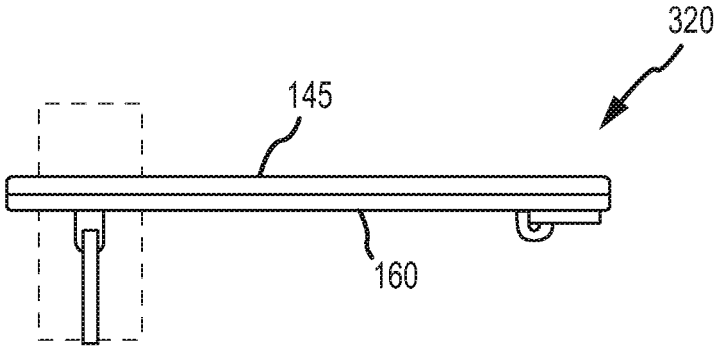
FIG. 12B shows a side elevation view of the table shown in FIG. 9A, showing a lower container support in a vertical position.

FIGS. 9A and 10-12B show various views of a third embodiment of the table 320, and FIG. 9B shows a fourth embodiment of the table 420. The third embodiment of the table 320 may include first and second bodies 325, 330 joined together to form the table 320. When joined, the first body 320 may define the upper surface 145 of the table 320, and the second body 330 may define the lower surface 160 of the table 320. The first and second bodies 325, 330 may be formed from a polymer, such as ABS plastic, or any other suitable material. The first body 325 may further include multiple sidewalls 335 that define the thickness of the table 320. The sidewalls 335 may cantilever from a planar element of the first body 325 that defines the upper surface 145 of the table 320. The multiple sidewalls 335 may be configured to define a rectangular outer perimeter wall 340 and a honeycomb-like structure within the area defined by the outer perimeter wall 340. This honeycomb-like structure helps to provide structural rigidity to the upper and lower surfaces 145, 160 of the table 320 while minimizing the table's weight. At the free ends of the cantilevered sidewalls 335, the second body 330 may be joined to the first body 325. The second body 330 may be joined to the first body 325 by welding (e.g., sonic welding), adhering, or any other suitable connection mechanism.

The first and second bodies 325, 330 may each include a hole 345, 350. The holes 345, 350 may be similar in size and positioned on their respective bodies 325, 330 to co-axially align when the first and second bodies 325, 330 are joined. Further, when these two bodies 325, 330 are joined, the holes 345, 350 may define a container hole for receiving a circular or cylindrical container therethrough. Proximate the hole 345 in the first body 325, a pair of posts 355 or other projections may cantilever downward from the hole 345. The posts 355 may be positioned on diametrically opposite sides of the hole 345. Proximate the hole 350 of the second body 330, slots 360 may be formed that are configured to receive the posts 355 therethrough when the first and second bodies 325, 330 are joined.

Each post 355 may include a post hole 365. The post hole 365 may be configured to receive a projection 370 from a container support 375. The container support 375 may include a pair of legs 380, each leg 380 cantilevered from an end portion of a base portion 385. At the free end of each leg 380, a projection 370 may extend transversely from the leg 380. The projection may be sized to be received snug tightly within one of the post holes 365 of the posts 355. When the projections 370 are received within the post holes 365, the container support 375 is joined to the table 320. The projections 370 and post holes 365 may further be configured to allow the container support 375 to be pivoted relative to the posts 355. For example, the projections 370 and the post holes 365 may have sufficient frictional engagement to generally maintain the position of the container support 375 relative to the table 320 while allowing for the container support 375 to be pivoted to other positions relative to the posts 355 by exerting sufficient force on the container support 375 to overcome the frictional force that maintains the position of the container support 375 relative to the posts 355. Selective rotation of the container support 375 relative to the posts 355 allows the container support 375 to be moved from an operation configuration (i.e., the legs 380 of the container support 375 extend transversely relative to the upper surface 145 of the table 320) to a storage configuration (i.e., the legs 380 of the container support 375 are substantially parallel to the upper surface 145 of the table 320). In the operation configuration, the base portion 385 of the container support 375 provides a bottom support for a container positioned in the container hole of the table 320. This bottom support helps to prevent the container from falling through the container hole.

The first body 325 may further include a pair of J-shaped hooks 390 that cantilever downwardly from the planar element of the first body 325 (i.e., the element that defines the upper surface 145 of the table 320). The second body 330 may include slots 395 configured and sized to receive the hooks 390 therethrough when the first and second bodies 325, 330 are joined. Each hook 390 may be used to join a respective first connector 275 to the table 320. Specifically, a portion of the hook 390 may be received in a first connector hole for any of the embodiments of the first connector 175, 275 described above to pivotally join the first connector to the table 320. The first connector 175, 275 may then be joined to a guide 165 as described above for the first two versions of the table 120, 220 to allow the third version of the table 320 to be joined to the guide 165. As also described in more detail above, the first connectors 175, 275 allow the table 320 to pivot relative to the suitcase 100 and to move (e.g., slide) along the guides 165.

The fourth embodiment of the table 420 may be substantially similar to the third embodiment of the table 320 except for the configuration of the first connectors 275. In particular, with reference to FIG. 9A, the open end of each slot for the first connectors 275 each face in the same direction for the third embodiment of the table 320. For the fourth embodiment of the table 420, the open end of each slot for the first connectors 275 face in opposite directions. More particularly, with reference to FIG. 9B, each first connector's slot open end is positioned to be located toward the centerline of the table 420. Such a configuration may help to increase the stability of the table 420 when joined to the guides 165 with the first connectors 275. If desired, each first connector's slot for any of the tables that have a first connector with an open ended slot may be configured to be located towards the outer edges of the table, as shown, for example, in FIG. 8*a*.

Figure 13:
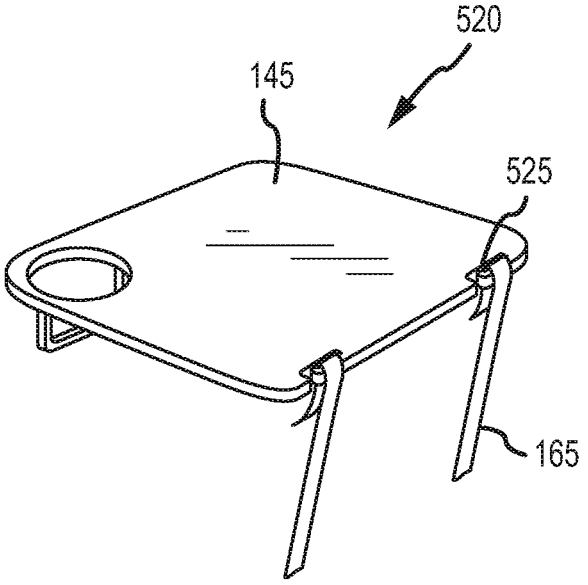
FIG. 13 shows a top perspective view of a fifth version of the table.
Figure 14:
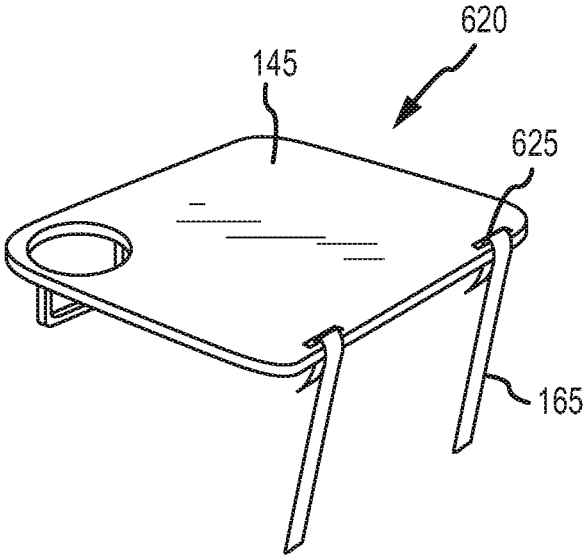
FIG. 14 shows a top perspective view of a sixth version of the table.

In some embodiments, the connector assemblies may be omitted. FIGS. 13 and 14 depict two versions of the table 520, 620 where the connector assemblies are omitted. In these two versions of the table 520, 620, the table may include one or more table connector slots 525 (FIG. 13) or table connector holes 625 (FIG. 14). While each table 520, 620 shows either two table connector slots 525 (FIG. 13) or two table connector holes 625 (FIG. 14), more or less than two table connector slots 525 or table connector apertures 625 may be used. Generally, the number of table connector slots 525 or table connector holes 625 equal the number of guides 165.

For each version of the table 520, 620, each table 520, 620 may be joined to a respective guide 165 by using an end portion of the guide 165. In particular, an end portion of the guide 165 may be positioned proximate the table connector slot 525 (FIG. 13) or the table connector hole 625 (FIG. 14) at the upper planar surface 145 of the table. The guide 165 may then bent approximately 180 degrees and passed through the table connector slot 525 (FIG. 13) or the table connector hole 625 (FIG. 14) such that the guide 165 extends from the upper planar surface 145 to the lower planar surface 160 of the table. This end portion of the guide 165 may then be joined to its respective panel proximate the upper surface of the suitcase 100, thus effectively joining the guide 165 to the table.

Like the other versions of the tables, once joined to the one or more guides 165, each table 520, 620 may be slid along the guides 165 and pivoted relative to the suitcase 100. Further, for the version of the table 520 that uses table connector slots 525 (FIG. 13), each connector slot 525 may be open at one end to allow the table 520 to be readily removed from its respective guides 165, thus allowing the table 520 to be disconnected from the suitcase 100. For the version of the table 620 that uses table connector holes 625 (FIG. 14), the guides 165 may be joined to their respective panels to be disconnected from them as described above to allow the table 620 to be disconnected from the guides 165, and thus disconnected from the suitcase 100.

Figure 15:
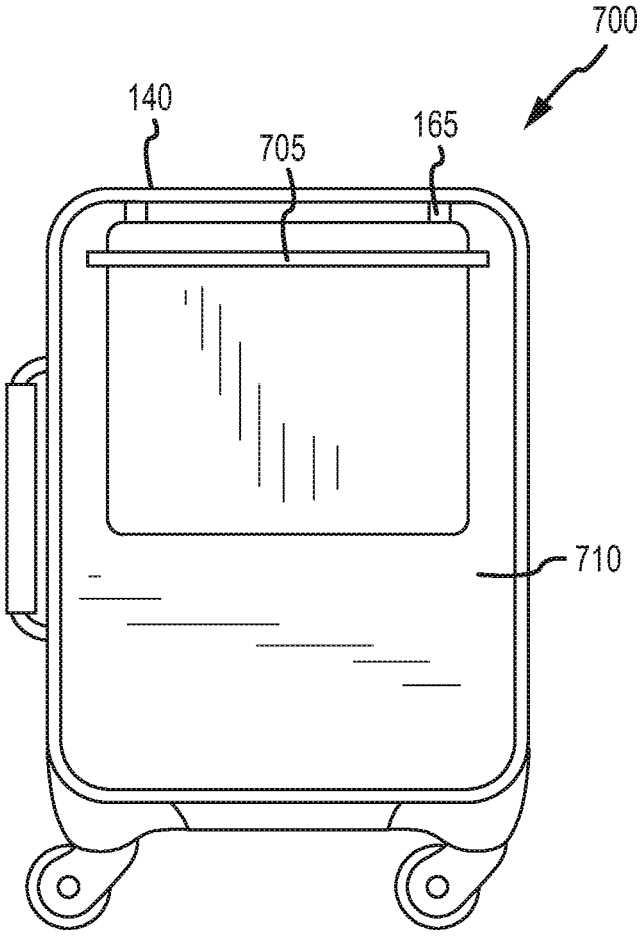
FIG. 15 shows a rear elevation schematic view of a suitcase where the table is stored on an outer surface of the suitcase.
Figure 16:
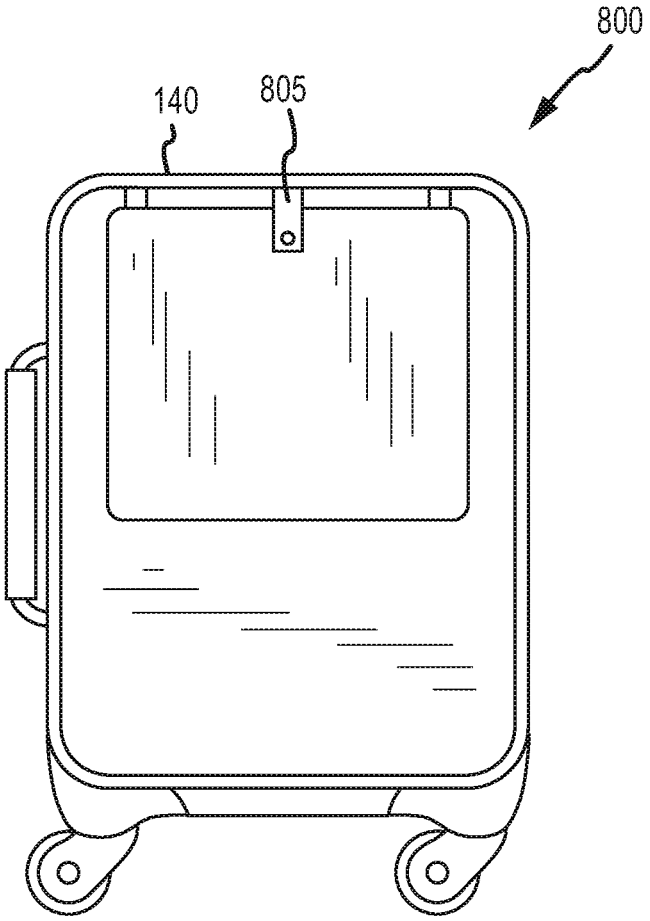
FIG. 16 shows a rear elevation schematic view of a suitcase, showing another way to store the table on an outer surface of the suitcase.
Figure 17:
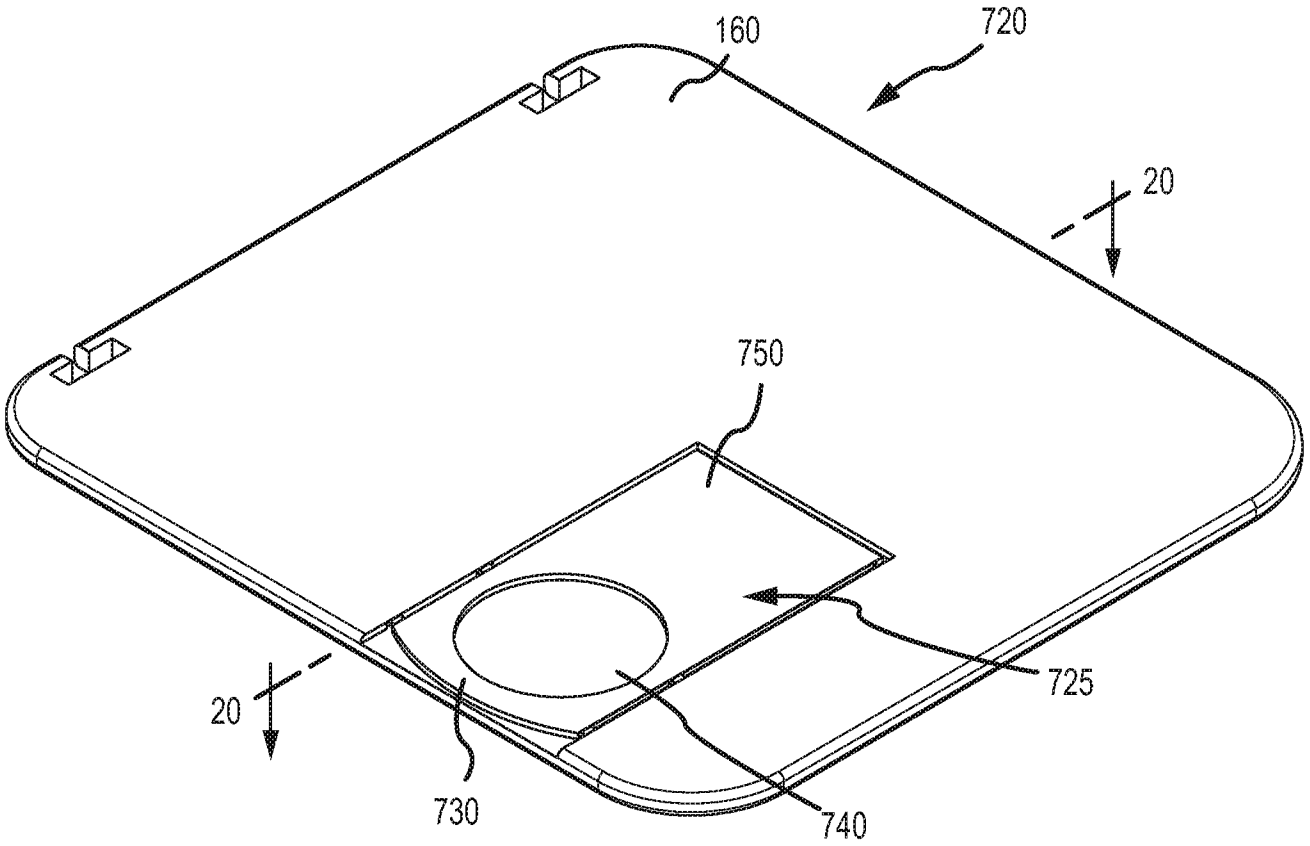
FIG. 17 shows a bottom perspective view of a seventh version of the table.
Figure 18:
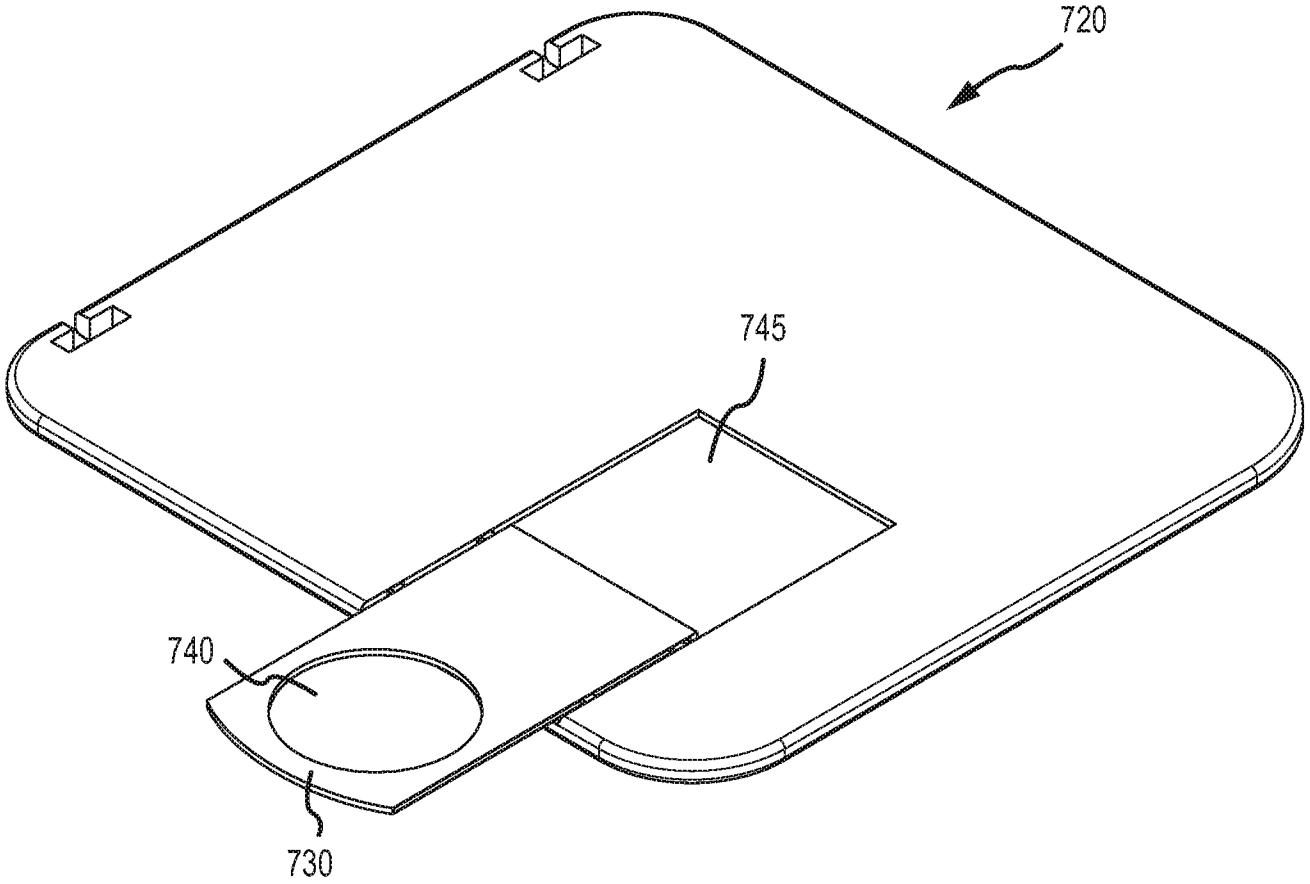
FIG. 18 shows another bottom perspective of the table shown in FIG. 17.

In some versions of suitcases that include tables, the table may be stored on the outer surface of the suitcases rather than in pockets or other enclosed spaces. FIGS. 15 and 16 show two versions of suitcases 700, 800 where the table is stored outside the suitcase proximate a rear outer panel of the suitcase. In these suitcase versions, a suitable support mechanism may be joined to the suitcase to maintain the table in its stored position. Further, similar to the previously described tables, these tables may be movably joined to the suitcase using guides positioned on the outer surface of the suitcase.

For the version of the suitcase 700 and table shown in FIG. 15, the support mechanism may be an elastic strap 705 or the like may be joined to the rear outer panel 710 of the suitcase 700 proximate the upper outer surface 140 of the suitcase 700. The elastic strap 705 may be configured to be slightly longer than the width of the table and joined to the suitcase 700 to be biased towards the rear outer panel 710. When the table is located at its storage position, the table may be placed between the elastic strap 705 and the rear outer panel 710. In this configuration, the elastic strap 705, which is biased to return towards the rear outer panel 710, presses the table against the rear outer panel 710 to help maintain the position of the table relative to the suitcase 700. To move the table to its operational position, the elastic strap 705 may be pulled away from the table, and the table may be slid upward along the guides 165 until no portion of the table is located between the elastic strap 705 and the rear outer panel 710. Once the table is clear of the elastic strap 705, the elastic strap 705 may be released to return to its default position. The table, meanwhile, may be pivoted to rest on the upper outer surface 140 of the suitcase 700. To return the table to its storage position, the steps may be reversed. In some embodiments, it may not be necessary to lift the elastic strap 705 to slid the table up and down the suitcase 700 along the guides 165. In such embodiments, a sufficient upward or downward force may be applied to the table to overcome the friction forces maintaining the table in its storage configuration.

For the version of the suitcase 800 and table shown in FIG. 16, the support mechanism may be a fastening strap 805 joined to the suitcase 800 proximate the upper surface 140 of the suitcase 800. The fastening strap 805 may include one component of a fastening mechanism that engages a corresponding component of the fastening mechanism that is joined to the table. The fastening mechanism may be any suitable mechanical fastening mechanism, including, but not limited to a Velcro™ fastener, a snap connector, a screw and threaded hole, and so on. When the table is located in its stored position, the fastening strap may be joined to the table via the fastening mechanism to maintain the position of the table relative to the rear outer panel. To move the table to its operational position, the fastening strap may be disconnected from the table via the fastening mechanism, and the table may be moved into its operational position as described above for other versions of the suitcase. These steps may then be reversed to return the table to its stored position.

FIGS. 17-44 show additional table versions. Like the previously described versions of the tables, each of these tables may be configured to support various objects, may be made from any suitable material (e.g., plastic, wood, and so on) or combination of materials, may be configured to be stored within a pocket or on the exterior of a suitcase, may be configured to be positioned on an outer surface (e.g., the upper outer surface) of a suitcase to provide a work or other relatively planar surface for a user, may include a handle recess sized to receive at least a portion of a carry handle, and may include a connector assembly, connector slots, or connector holes to allow the table to be selectively or permanently joined to the suitcase. At least some of the tables may further include a container support, such as a cup holder or the like. Each container support, however, may differ slightly from the other container supports for other versions of the tables.

With reference to FIGS. 17-20, a seventh version of the table 720 may include a container support assembly 725. The container support assembly 725 may include a container or cup holder member 730 and one or more stop members 735. The cup holder member 730 may include a planar body with a desired thickness. The planar body may define an aperture 740. The aperture 740 may be sized to receive a cylindrical container or the like of a predetermined size and to secure the container to the cup holder member 730. The table 720 may include a cup holder recess 745 sized to receive the cup holder member 730 so that an outward facing surface 750 of the cup holder member 730 may be flush with the bottom surface 160 of the table 720. The cup holder recess 745 also provides a stopping point when positioning the cup holder member 730 into a storage position, thus providing an indication to the user of when the cup holder member 730 is positioned in a preferred storage position.

The planar body of the cup holder member 730 may further define a pair of slots 755 or grooves that are positioned within opposing longitudinal edges of the planar body. Each slot 755 may be configured to receive at least portions of one or more of the stop members 735 therein. The slots 755 and the stop members 735 may further be configured so that the stop members 735 act as guides or the like that allow for the cup holder member 730 to be selectively moved in a sliding manner relative to the table 720. The slots 755 and the stop members 735 may further be configured so that closed end portions of the slots 755 selectively engage one of the stop members 735. Such engagement limits further sliding movement of the cup holder member 730 relative to the table 720 in a predetermined direction.

Figure 19:
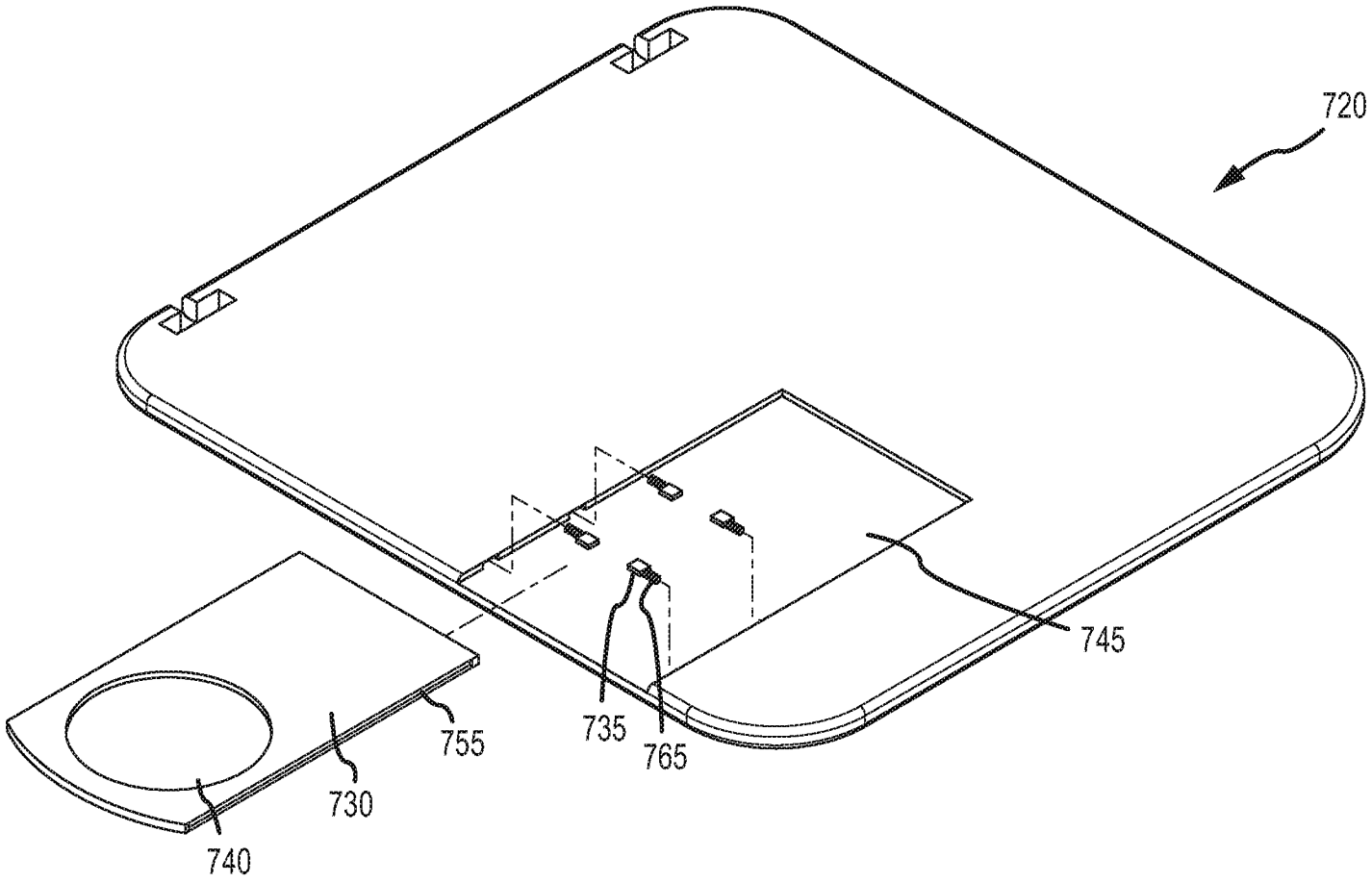
FIG. 19 shows an exploded perspective view of the table shown in FIG. 17.
Figure 20:
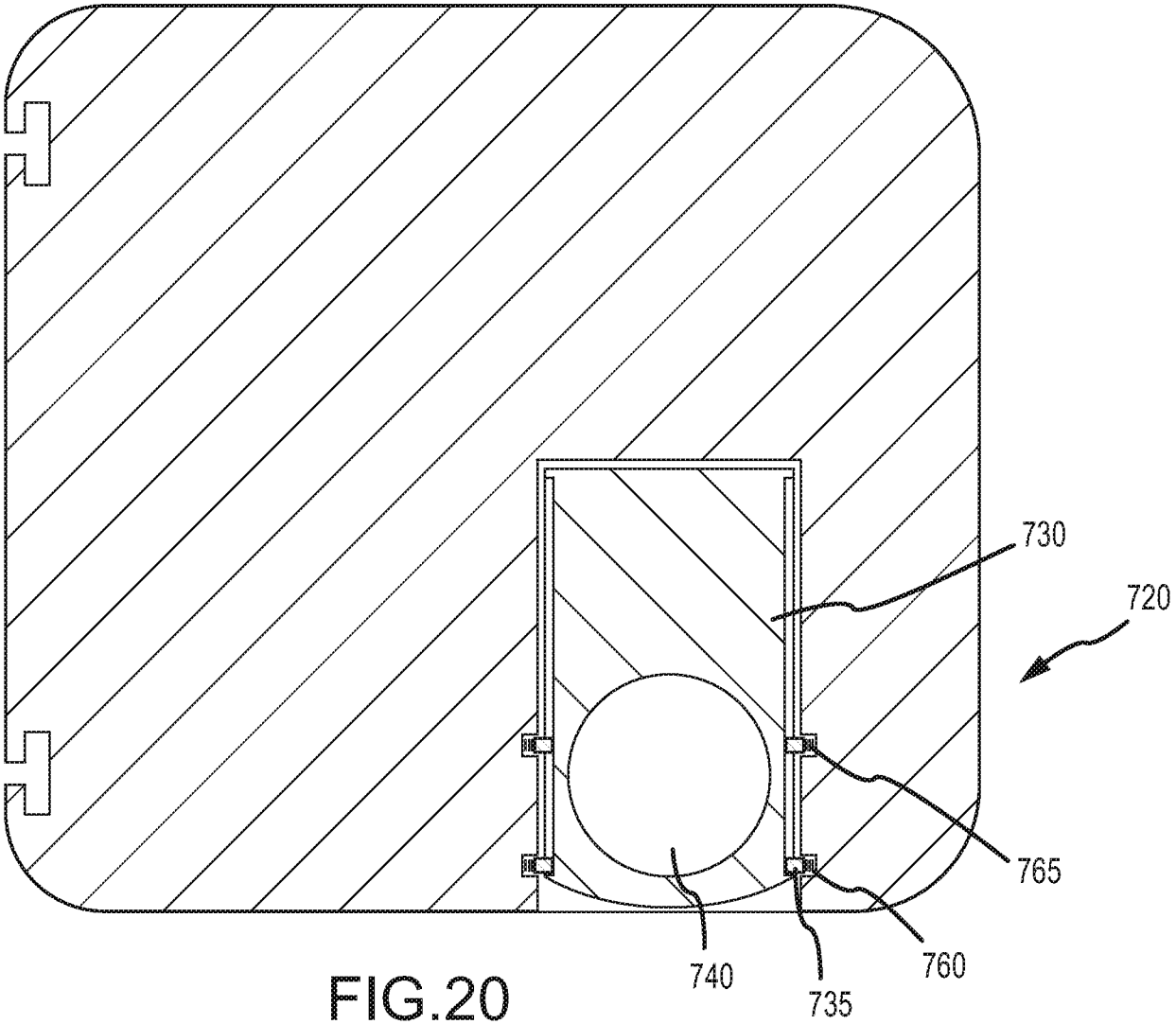
FIG. 20 shows a cross-section view of the table shown in FIG. 17, viewed along line 20-20 in FIG. 17.

With reference to FIGS. 19 and 20, each stop member 735 may be configured to take of the form of a rectangular or other suitably shaped post or the like that is sized to be received within one of slots 755 of the cup holder member 730. Each stop member 735 may be positioned within a slot member hole 760 defined in the table 720. A bias member 765, such as a spring or the like, may be placed in each stop member hole 760. Each bias member 765 may be positioned between the table 720 and a respective stop member 735 and configured to bias the stop member 735 towards the cup holder member 730. This biasing helps to maintain the stop member 735 within a respective slot 755 of the cup holder member 730.

Returning to FIGS. 17 and 18, the cup holder member 730 may be selectively moved from a storage position, such as shown in FIG. 17, to an operational position, such as shown in FIG. 18. In the storage position, the aperture 740 for the cup holder member 730 may be located next the recessed surface of the table 720. In other words, the cup holder member 730 may be located underneath the table 720. In the operational position, an end portion of the cup holder member 730 cantilevers from the table 720. This end portion contains the aperture 740, thus resulting in the aperture 740 being visible when viewing the top surface 145 of the table 720. In other words, the aperture 740 is no longer positioned directly underneath the table 720. Further, in this position, a user may place a cylindrical or other suitably shaped container within the aperture 740, thus allowing a user to temporarily store the container within the aperture 740. To further enhance securing the container to the cup holder member 730, an elastomeric material, such as rubber to the like, may be positioned around the perimeter edge of the aperture 740. As described in more detail above for the second embodiment of the table 220, the elastomeric material may be configured to frictionally grip the container placed in the aperture 740.

To move the cup holder member 740 back and forth between the storage and operational configurations, a user may selectively slide the cup holder member 730 relative to the table 720 in a direction that is substantially parallel to the lengths of the slots 755 of the cup holder member 730. Further, as the cup holder member 730 is slid from its storage position to its operational position, first end portions of the slots 755 may engage one of the stop members 735. Such engagement prevents further cantilevering of the end portion of the cup holder member 730 away from the table 720. This engagement also provides an indication to the user that the cup holder member 730 is positioned in its operational configuration, and thus is ready for a cylindrical or other suitably shaped container to be positioned within the aperture 740 of the cup holder member 730. Similarly, as the cup holder member 730 is slid from its operational position to its storage position, an edge of the cup holder member 730 may engage an end wall of the table 720 that defines the cup holder recess. This engagement may prevent further sliding movement of the cup holder member 730 in a direction from the operational position to the storage position. Further, such an engagement may provide an indication to the user that the cup holder member 730 is located in a preferred storage position.

While two stop members 735 are shown as used for each slot 755 of the cup holder member 730, more or less than two stop members 735 may be used for each slot 755. Further, in some embodiments, only a single slot may be defined in the cup holder member 730 rather than two slots.

Figure 21:
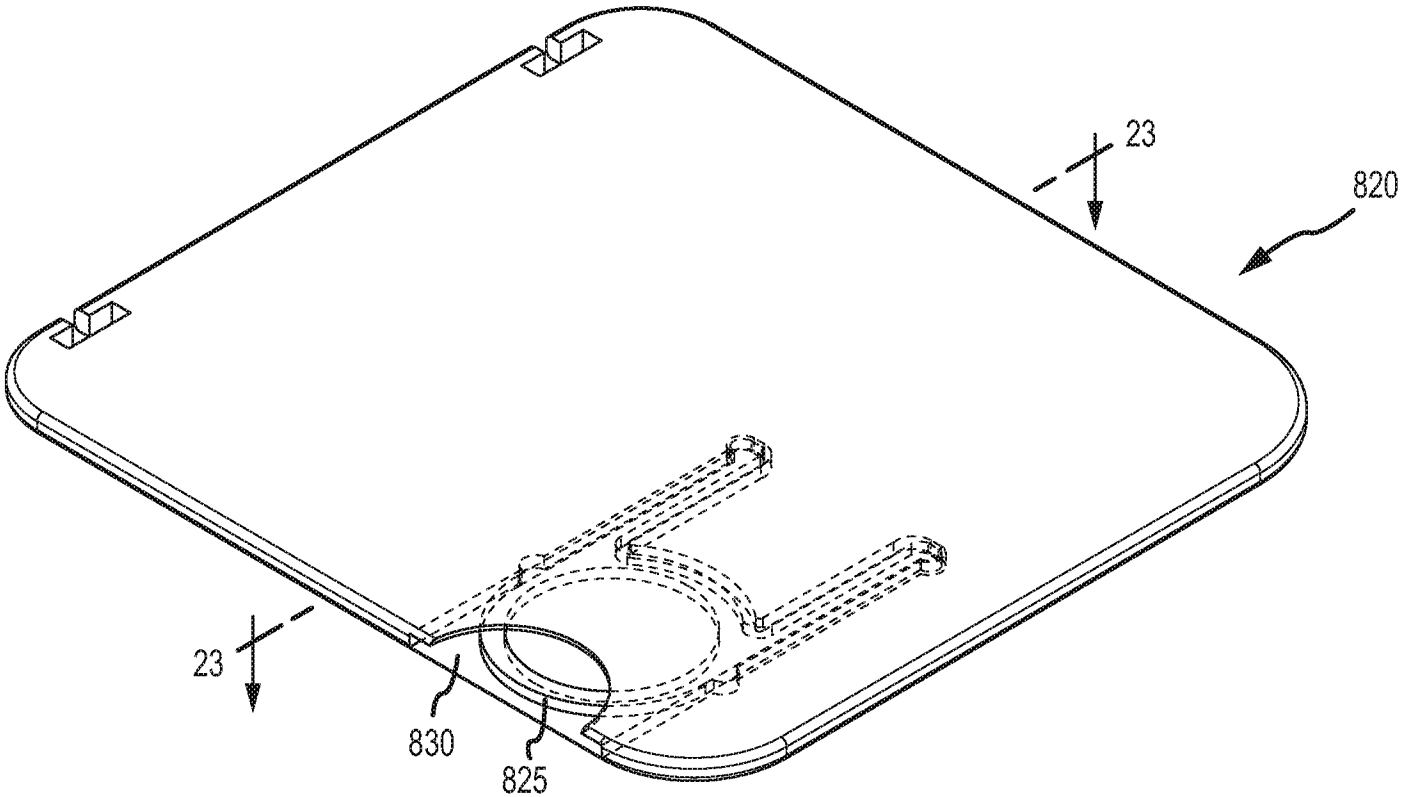
FIG. 21 shows a bottom perspective view of an eighth version of the table.
Figure 22:
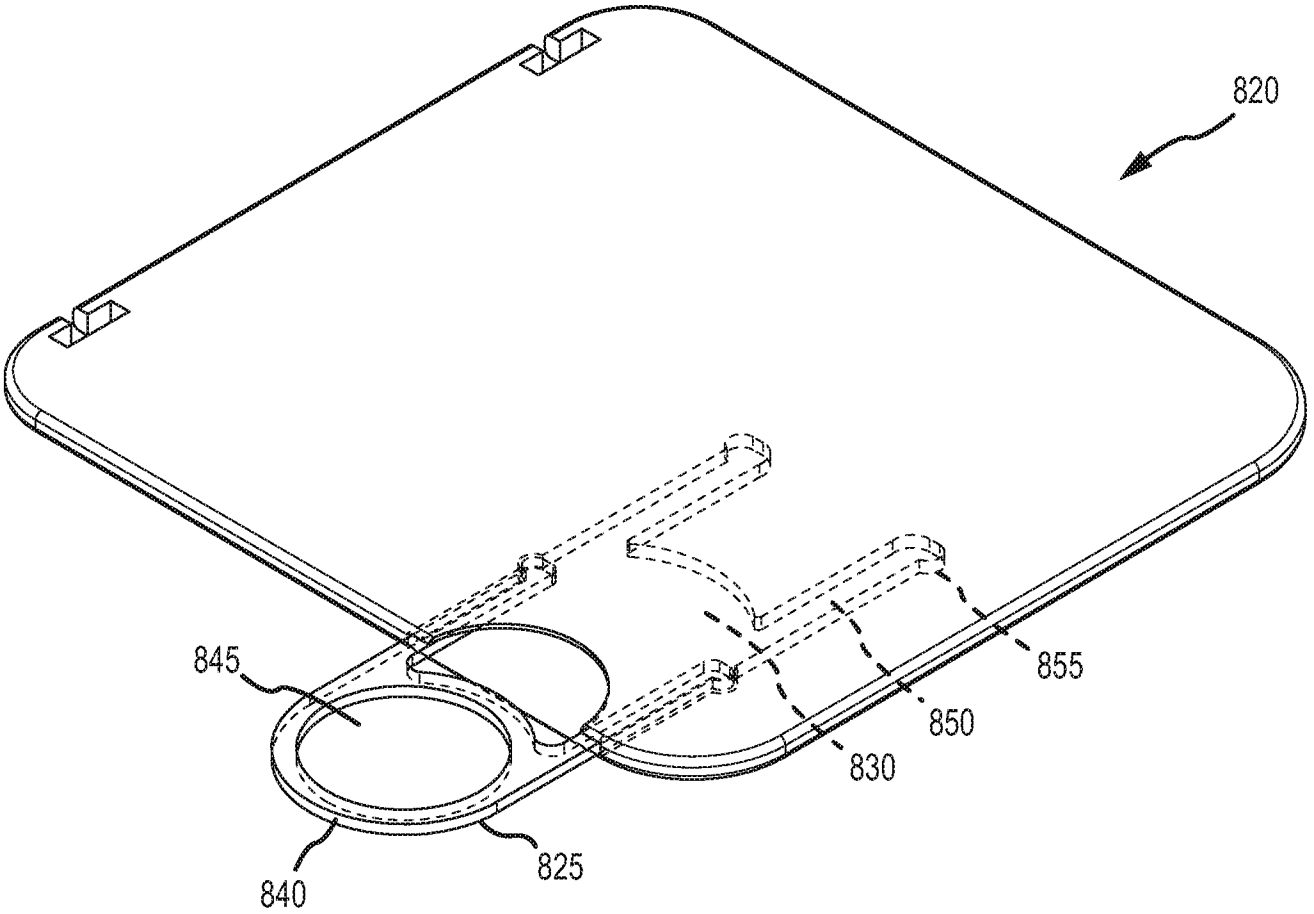
FIG. 22 shows another bottom perspective view of the table shown in FIG. 21.
Figure 23:
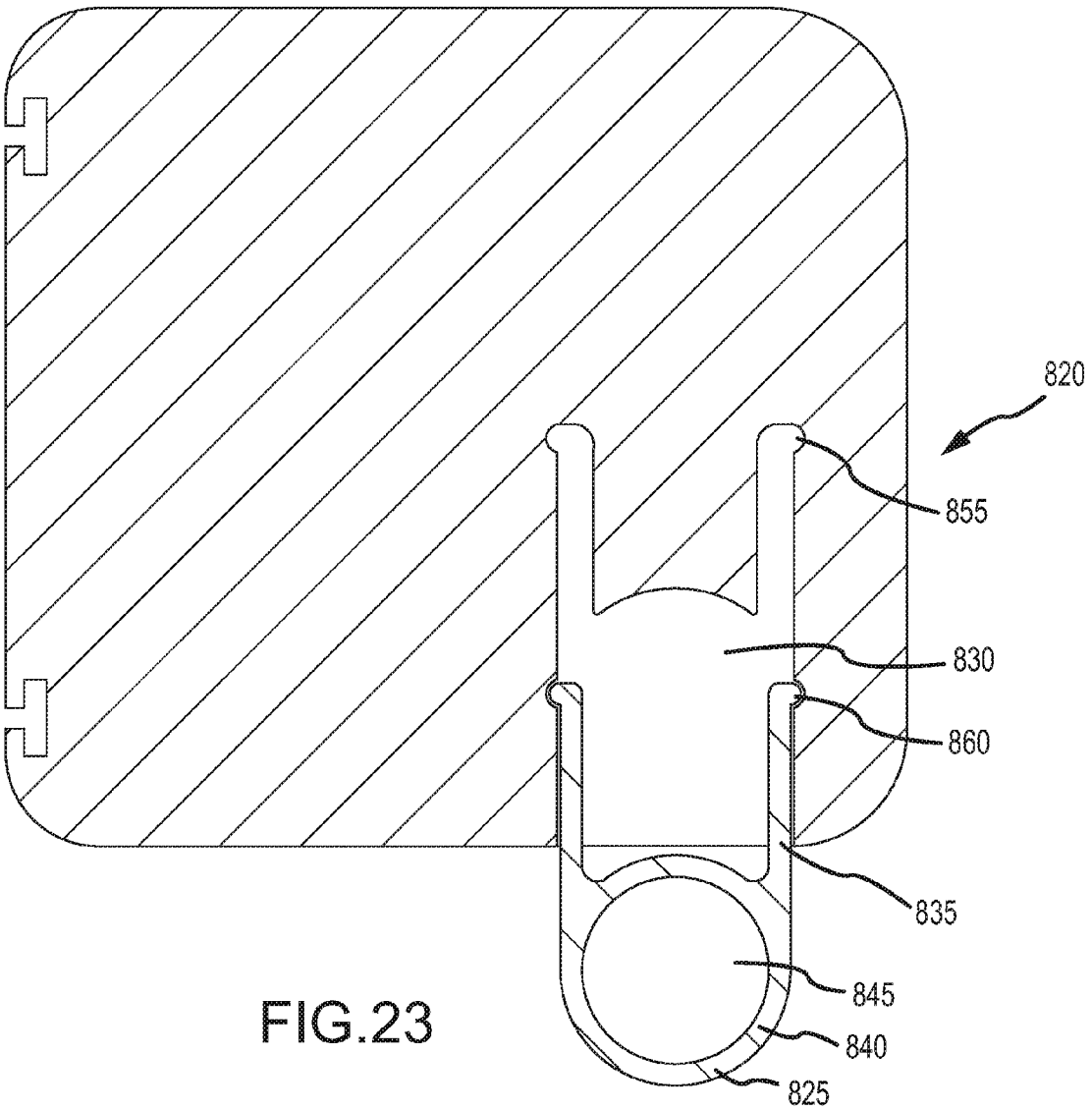
FIG. 23 shows a cross-section view of the table shown in FIG. 21, viewed along line 23-23 in FIG. 20.
Figure 24:
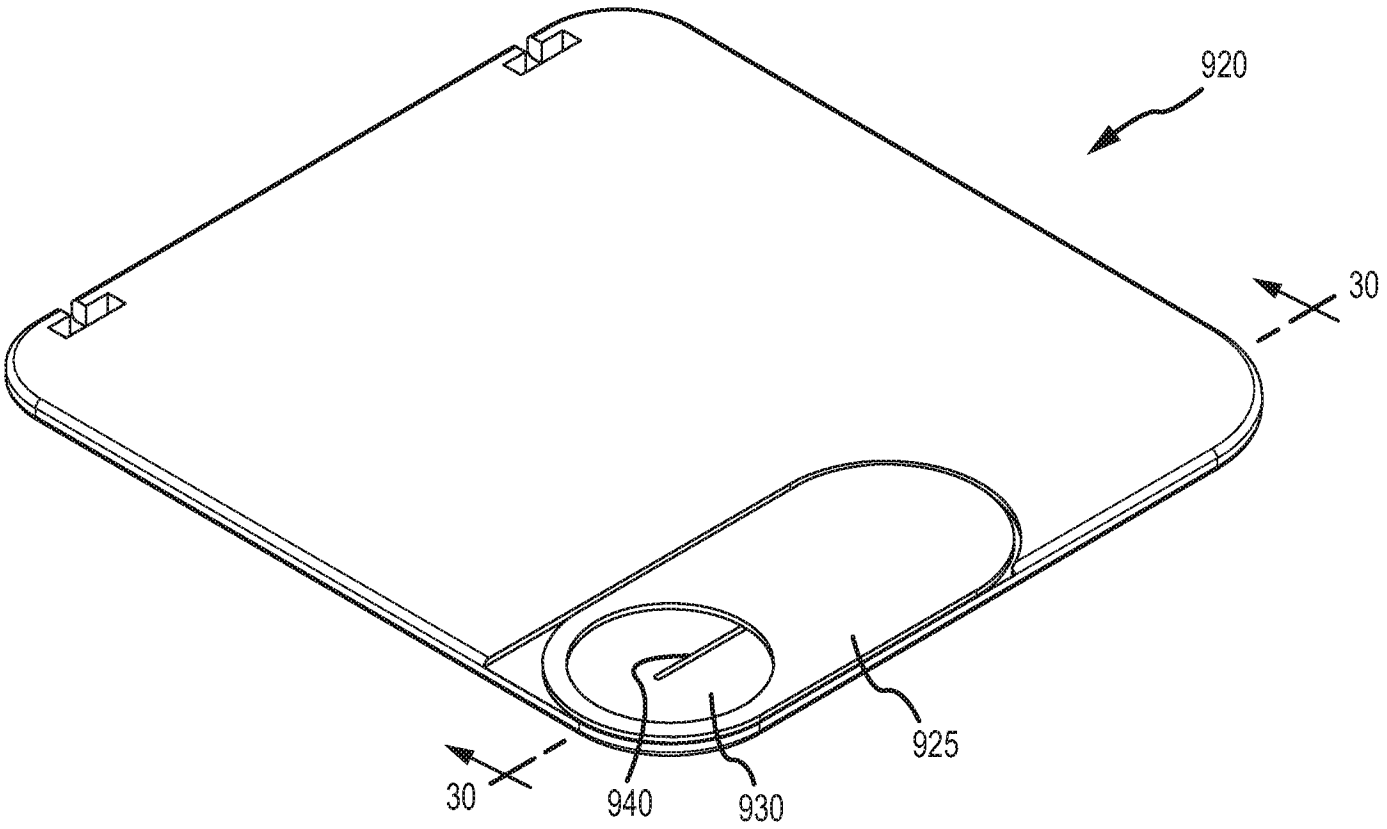
FIG. 24 shows a bottom perspective view of a ninth version of the table.
Figure 25:
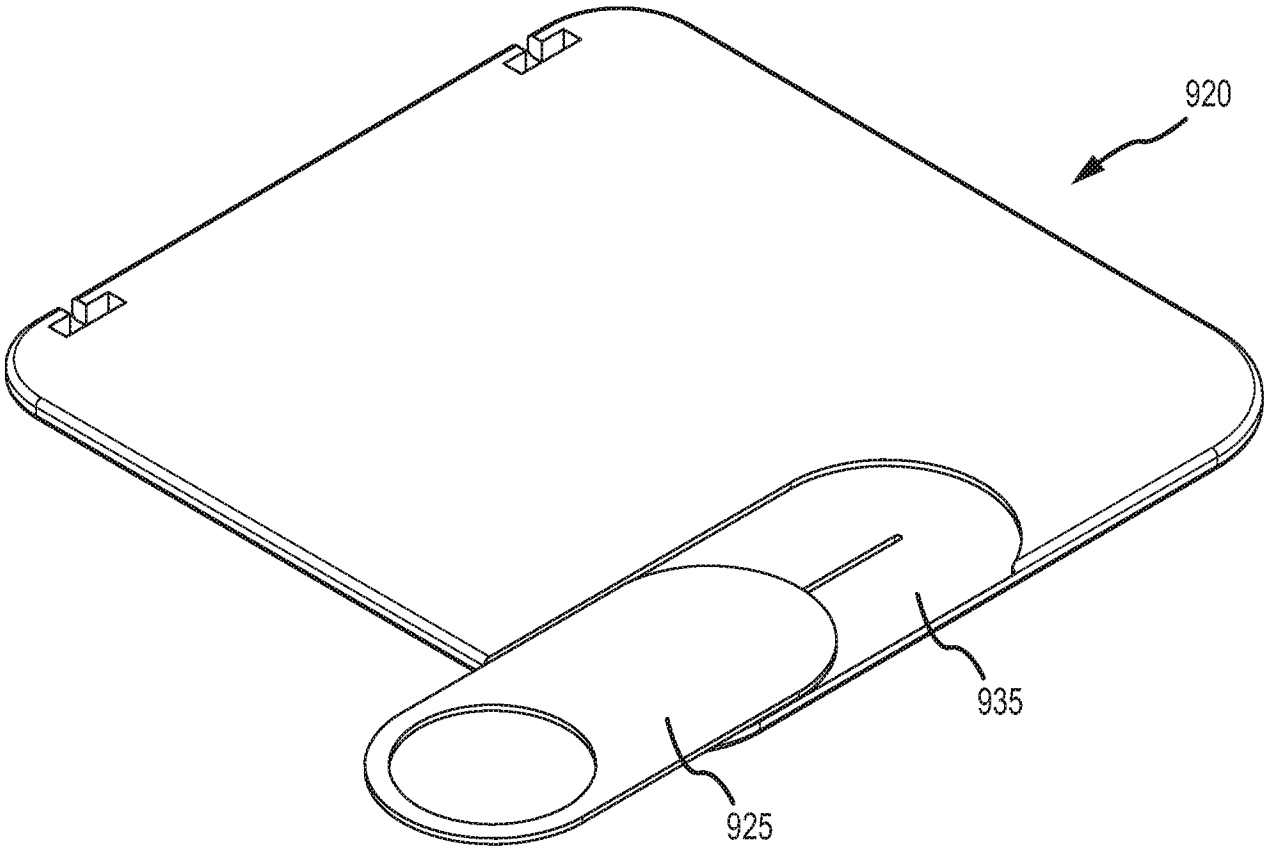
FIG. 25 shows another bottom perspective view of the table shown in FIG. 24.
Figure 26:
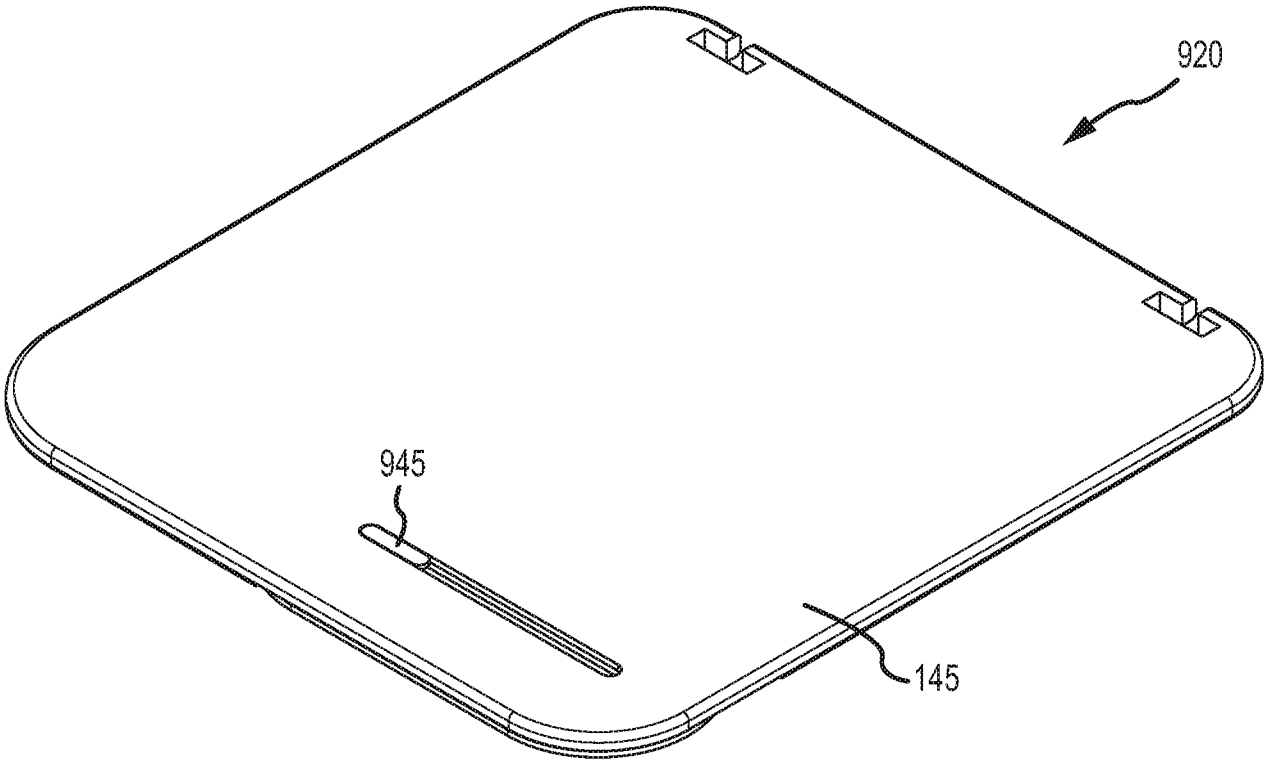
FIG. 26 shows a top perspective view of the table shown in FIG. 24.
Figure 27:
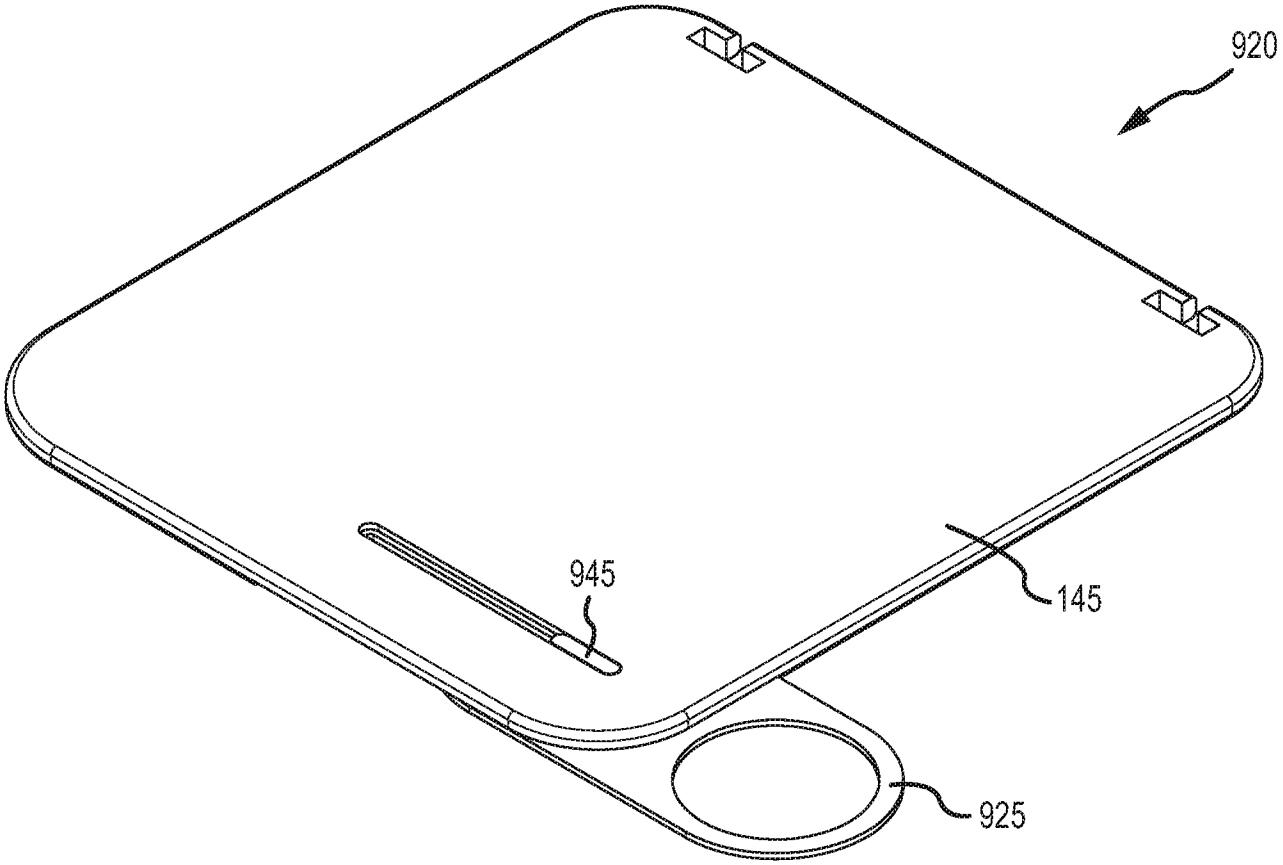
FIG. 27 shows another top perspective view of the table shown in FIG. 24.
Figure 28:
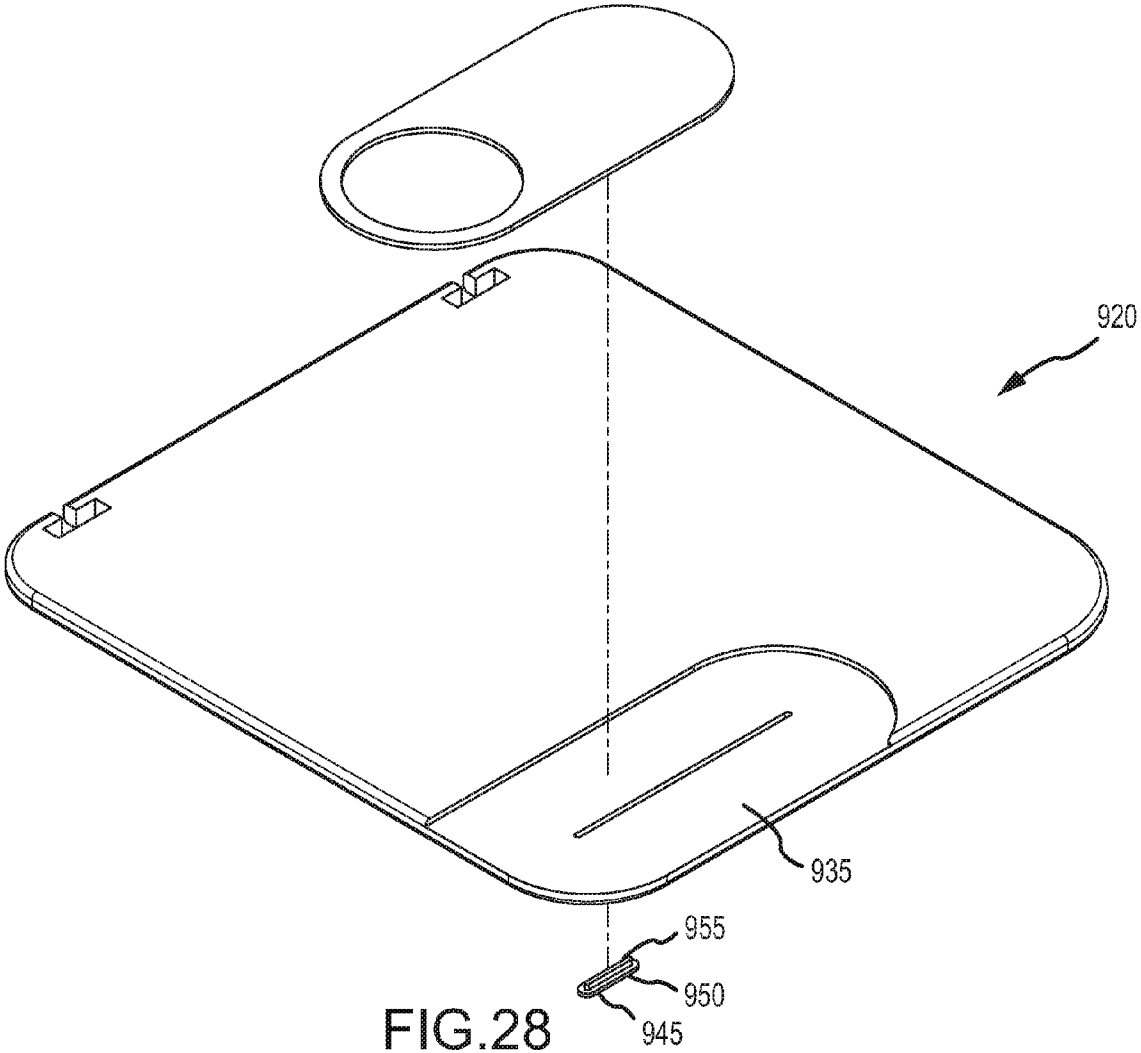
FIG. 28 shows an exploded bottom perspective view of the table shown in FIG. 24.

FIGS. 21-23 show an eighth version of the table 820. The eighth table 820 is similar to the seventh table 720 in that the eighth table 820 also includes a sliding cup holder member 825. The eighth table 820 differs from the seventh table 720 with respect to the details for the sliding cup holder member 825. More particularly, the container support assembly may include the container or cup holder member 825 and a cup holder member cavity 830. The cup holder member 825 may include a pair of leg portions 835 joined to a ring-like portion 840 that defines an aperture 845. Each leg portion 835 may be generally an elongated body that is configured to be slidingly received within respective sliding chambers 850 that are part of the cup holder member cavity 830. Each leg portion 835 may be generally rectangular in cross-section along its length or any other shape that generally matches the cross-sectional shape of its respective sliding chamber 850 along the length of the sliding chamber 850. Like the previously described cup holder member for the seventh table 720, the aperture 845 for the cup holder member 825 may be configured to receive a cylindrical or other shaped container of a predetermined size range therein and to secure to the received container to the cup holder member 825. Further, if desired, an elastomeric material may be positioned along the perimeter edge of the aperture 845 to further secure the container to the cup holder member 825.

The cup holder member cavity 830 may be defined within the thickness of the table 820. Further, the cup holder member cavity 830 may be covered by the top and bottom surfaces of the table 820 so that the cup holder member 825 is substantially not exposed outside of the table 820 when it is positioned in its storage position. The cup holder member cavity 830 may include the sliding chambers 850 for receiving the leg portions 835 of the cup holder member 825 and a main portion that receives the ring-like portion 840 of the cup holder member 825. The cup holder member cavity 830 may further define a pair of detent recesses 855 that are positioned next to one of the sliding chambers 850. Each detent recess 855 may be sized to receive a detent 860 that is positioned at the end portions of the leg portions 835 of the cup holder member 825. The detent 860 on each leg portion 835 and the corresponding detent recesses 855 may be used to secure the cup holder member 825 to the table 820 when positioned in its storage and operational positions.

With continued reference to FIGS. 21 and 22, the cup holder member 825 may be slidingly moved relative to the table 820 by selectively increasing and decreasing the length of each leg portion 835 of the cup holder member 825 that is positioned in its respective sliding chamber 850. As with the seventh table 720, the sliding cup holder member 825 for the eighth table 820 may further be selectively moved between a storage position in which the aperture 845 is positioned proximate the bottom surface of the table 820 and an operational position in which the aperture 845 is exposed to view from a top surface of the table 820.

To provide an indication of when the cup holder member 825 is located in its operational position, the detent 860 on each leg portion 835 of the cup holder member 825 may be received within a corresponding cup holder member detent recess 855. The leg portions 835, in turn, may be formed of a flexible metal or otherwise made of a material that is configured so that the leg portions 835 may move slightly inward so that when a user applies a sufficient force in the direction that the cup holder member 825 slides, the detents 860 move out of their corresponding detent recesses 855. Further, as the user slides the cup holder member 825 from the operational position to the storage position, the detent 860 of each leg portion 835 eventually aligns with the corresponding detent recess 855 formed at the closed ends of a respective sliding chamber 850. When aligned, the leg portions 835 may be configured to move their respective detent 860 into the corresponding detent recess 855. Such movement provides an indication to the user that the cup holder member 825 is located in its preferred storage position. Also, the receipt of the detents 860 in their corresponding detent recesses 855 secures the cup holder member 825 to the table 820 in the storage position.

The user may overcome the securing of the cup holder member 825 to the table 820 by applying sufficient force in the sliding direction from the storage position to the operational position to return the cup holder member 825 to its operational position. In particular, by applying a sufficient force in this direction, the flexible leg portions 835 may move sufficient inward so that the detents 860 may be removed from their respective detent recesses 855. As the user slides the cup holder member 825 from the storage position to the operational position, the detent 860 of each leg portion 835 eventually aligns with a corresponding detent recess 855 formed distal from the closed end of a respective sliding chamber 850. When aligned, the leg portions 835 may be configured to move their respective detent 860 into the corresponding detent recess 855. Such movement provides an indication to the user that the cup holder member 825 is located in its preferred operational position. Also, the receipt of the detents 860 in their corresponding detent recesses 855 secures the cup holder member 825 to the table 820 in the operational position.

FIGS. 24-30 show a ninth version of the table 920. The ninth version of the table 920 is similar to the seventh and eighth versions of the table 720, 820 in that it includes a sliding cup holder member 925. However, the ninth version of the table 920 differs from the seventh and eighth versions in the design of the sliding cup holder member 925. In particular, like the previous sliding cup holder members, the cup holder member 925 of the ninth version of the table 920 includes an aperture 930 sized for receipt of a container. Also, like the cup holder member for the seventh version of the table 720, the cup holder member 925 for the ninth version of the table 920 includes a planar body that is received within a cup holder recess 935. However, the table 920 includes a table slot 940 that generally extends through the table 920 from a surface of the table 920 that abuts the cup holder member 925 to the upper surface 145 of the table 920. A slider 945 or the like may then extend through the table slot 940 and be joined to the cup holder member 925 by any suitable mechanical or other attachment mechanism. The slider 945 may be used by the user to selectively slide the cup holder member 925 relative to the table 920 in the direction of the length of the table slot 940.

Figure 29:
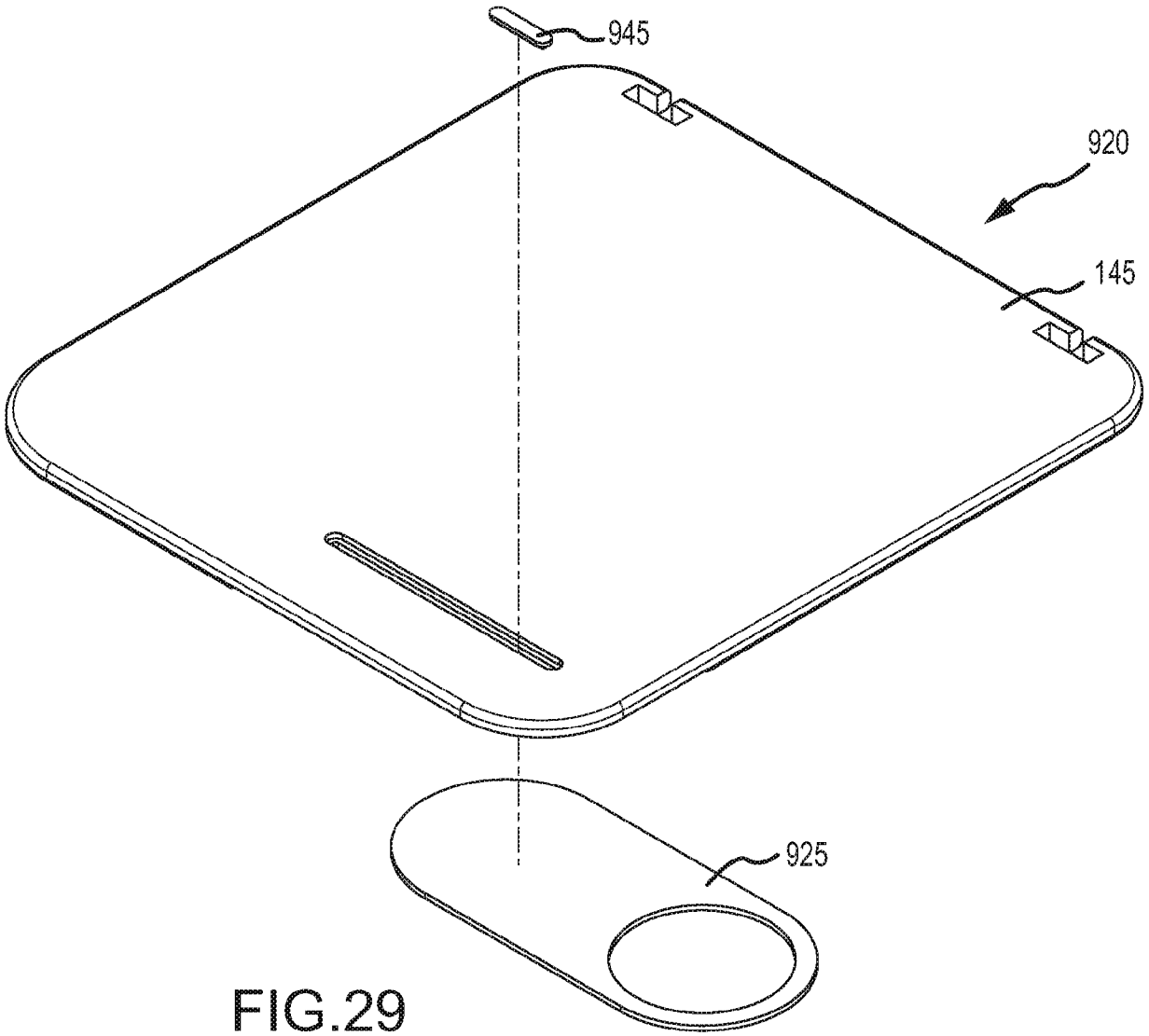
FIG. 29 shows an exploded top perspective view of the table shown in FIG. 24.
Figure 30:
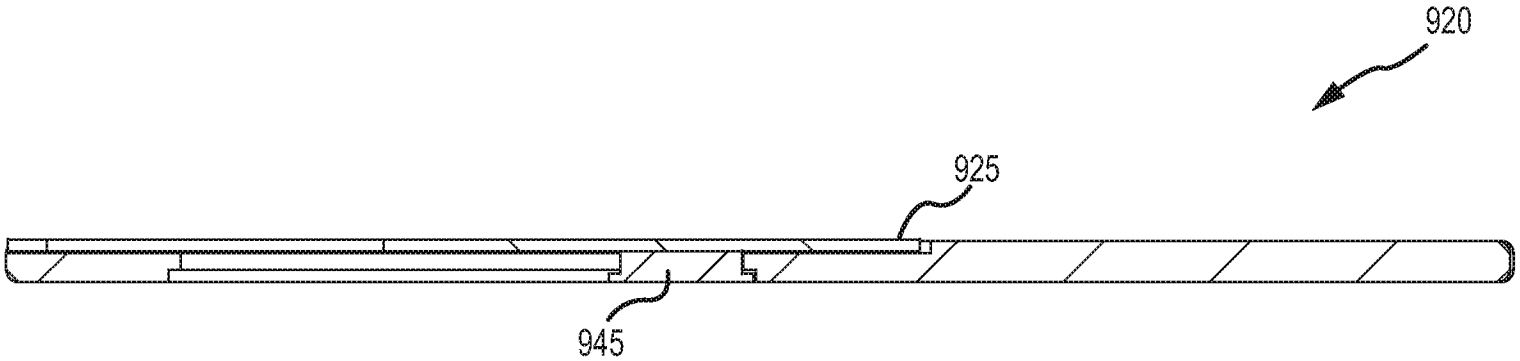
FIG. 30 shows a cross-section view of the table shown in FIG. 24, viewed along line 30-30 in FIG. 24.

With particular reference to FIGS. 29 and 30, the table slot 940 may include multiple slot widths. For example, the table slot 940 may have a first slot width proximate the upper surface 145 of the table 920 and a second slot width proximate the cup holder member 925. The first slot width may be greater than the second slot width. The slider 945, in turn, may include a main slider body 950 and a slider flange 955 or the like extending from the main slider body 950. The main slider body 950 may be generally rectangular planar in shape and sized for receipt with the portion of the table slot 940 including the first slot width. The planar body of the main slider body 950 may further be sized to be sufficiently wide to provide an adequate surface for the user to engage to selectively use the slider 945 to move the cup holder member 925. The slider flange 955 may be rectangular prism in shape and may be sized for receipt with the portion of the slider slot 940 including the second slot width. The slider flange 955 may further be sufficiently long to provide an adequate contact surface for joining the slider 945 to the cup holder member 925 and for transferring longitudinal movement forces applied by the user to the slider 945 from the slider 945 to the cup holder member 925. Yet further, the configuration of the table slot 940 with a first slot width greater than the second slot width allows for a top surface of the slider 945 to be substantially flush with the top surface 145 of the table 920 while also allowing for the slider 945 to be sufficiently wide proximate the top surface 145 of the table 920 to provide a user with an adequate engagement surface for contacting the slider 945 in order to use the slider 945 to selectively move the cup holder member 925 between its operational and storage positions.

As with the seventh embodiment of the table 720, engagement of an end wall of the cup holder member 925 with an end wall of cup holder recess 935 stops sliding movement of the cup holder member 925 from the operational position to the storage position. Further, such engagement provides an indication to the user that the cup holder member 925 is located in its preferred storage position. Similarly, engagement of the slider 945 with an end of the table slot 940 that is distal the end wall of the cup holder recess 935 stops sliding movement of the cup holder member 925 from its storage position to its operational position. This engagement provides an indication to the user that the cup holder member 925 is located in its preferred operational position.

Figure 31:
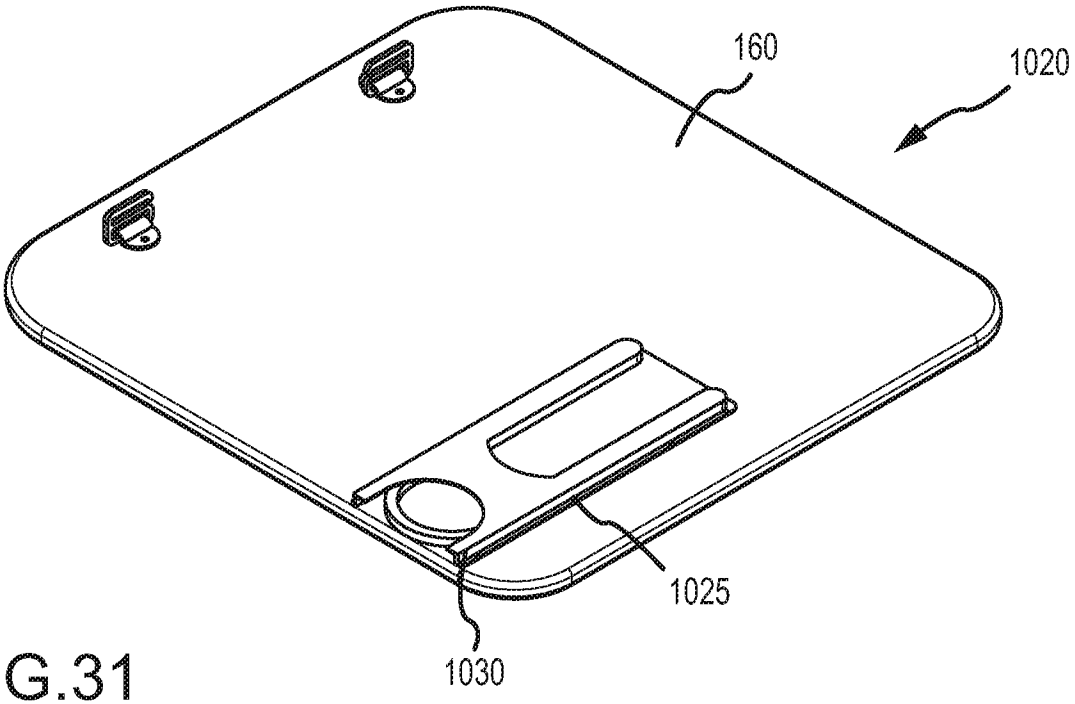
FIG. 31 shows a bottom perspective view of a tenth version of the table.
Figure 32:
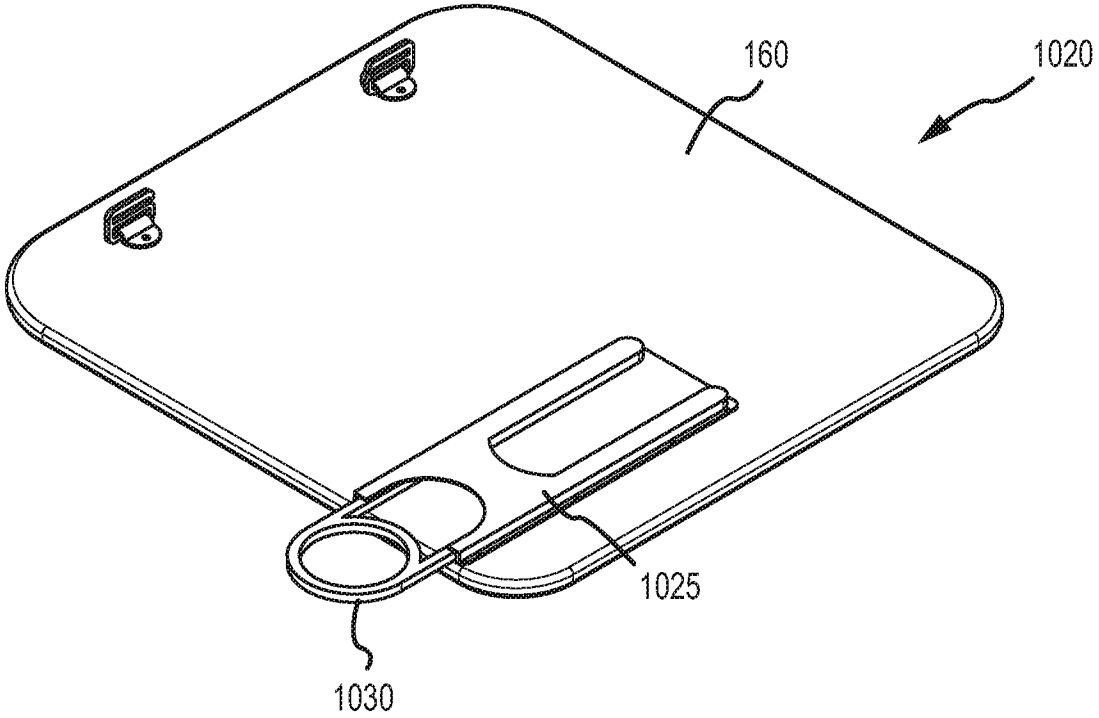
FIG. 32 shows another bottom perspective view of the table shown in FIG. 31.
Figure 33:
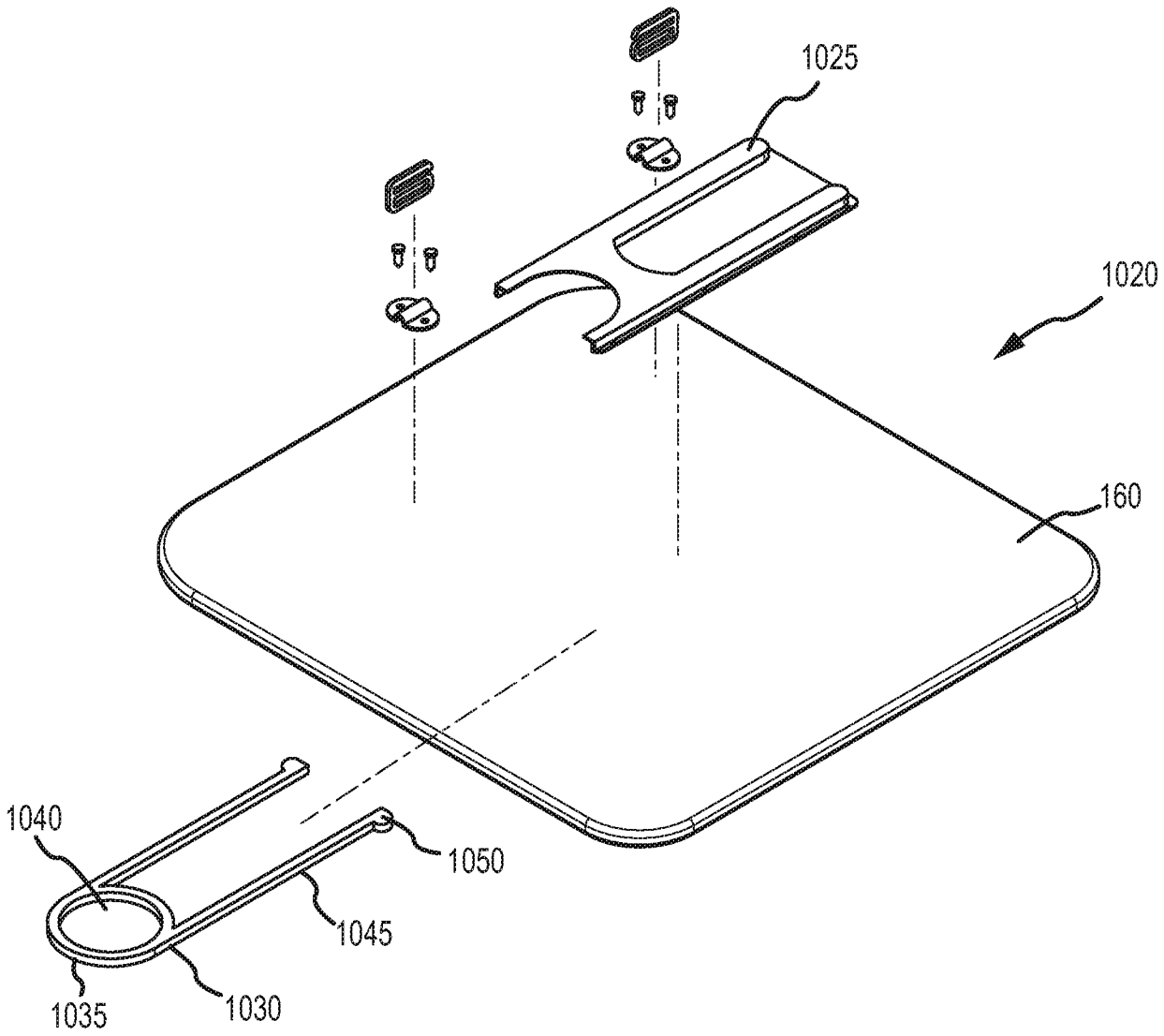
FIG. 33 shows an exploded perspective view of the table shown in FIG. 31.

FIGS. 31-33 show a tenth version of the table 1020. The tenth version of the table 1020 is similar to the eighth version of the table 820 except the table 1020 includes a cup holder housing 1025 to define a chamber that contains the cup holder member 1030 rather than the chamber being formed within the thickness of the table. In particular, the cup holder housing 1025 in conjunction with the lower surface 160 of the table 1020 define the chamber that contains the cup holder member 1030.

Like the eighth version of the table 820, the cup holder member 1030 for the tenth version of the table 1020 may include a ring-like portion 1035 containing an aperture 14040 and leg portions 1045 extending away from the ring-like portion 1030. Further, detents 1050 may be positioned at the free ends of the leg portions 1045. These detents 1050 may be configured for receipt within detent recesses (not shown) that may be defined by the cup holder housing 1025. As described above for the eighth version of the table 820, the detents 1050 and detent recesses may be configured to secure the cup holder member 1030 into its operational and storage positions. Further, the leg portions 1045 of the cup holder member 1030 may be sufficiently flexible to allow for a user to selectively remove the detents 1050 from their respective detent recesses in order to allow the user to selectively slide the cup holder member 1030 between its operational and storage positions.

Figure 34:
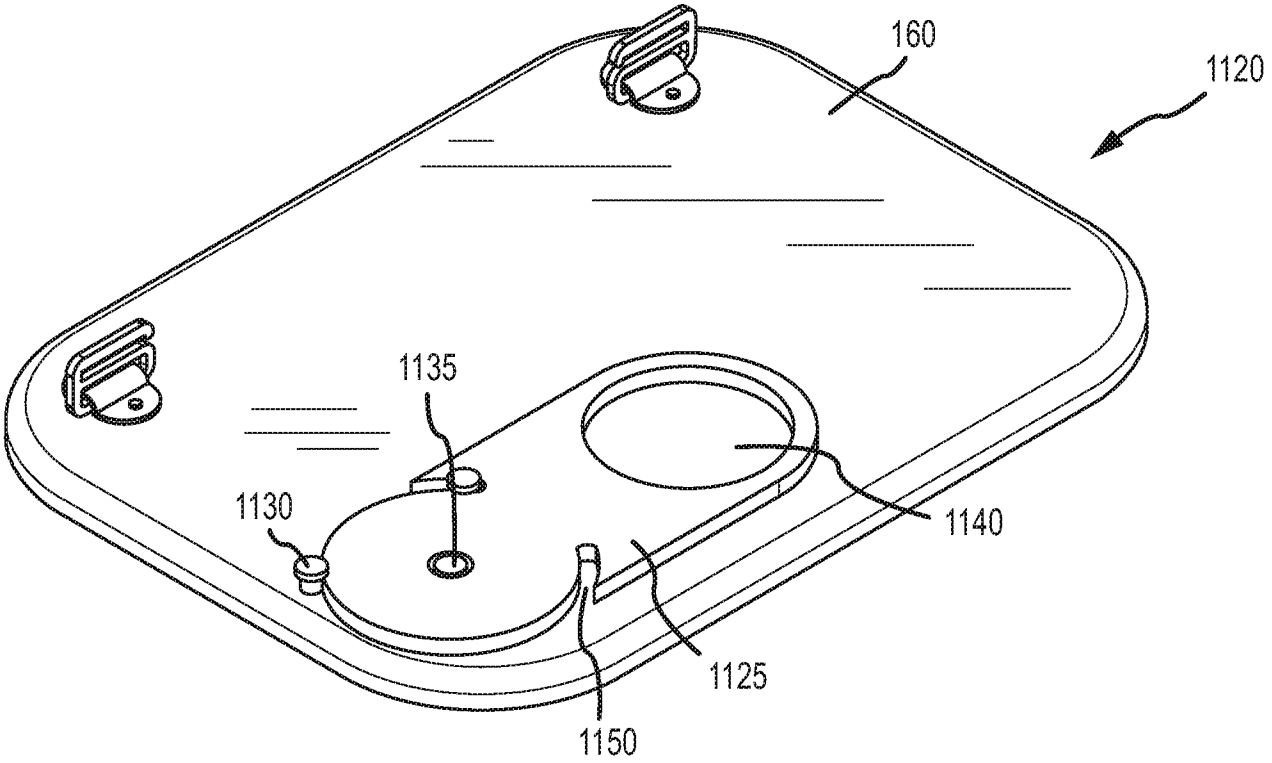
FIG. 34 shows a bottom perspective view of an eleventh version of the table.
Figure 35:
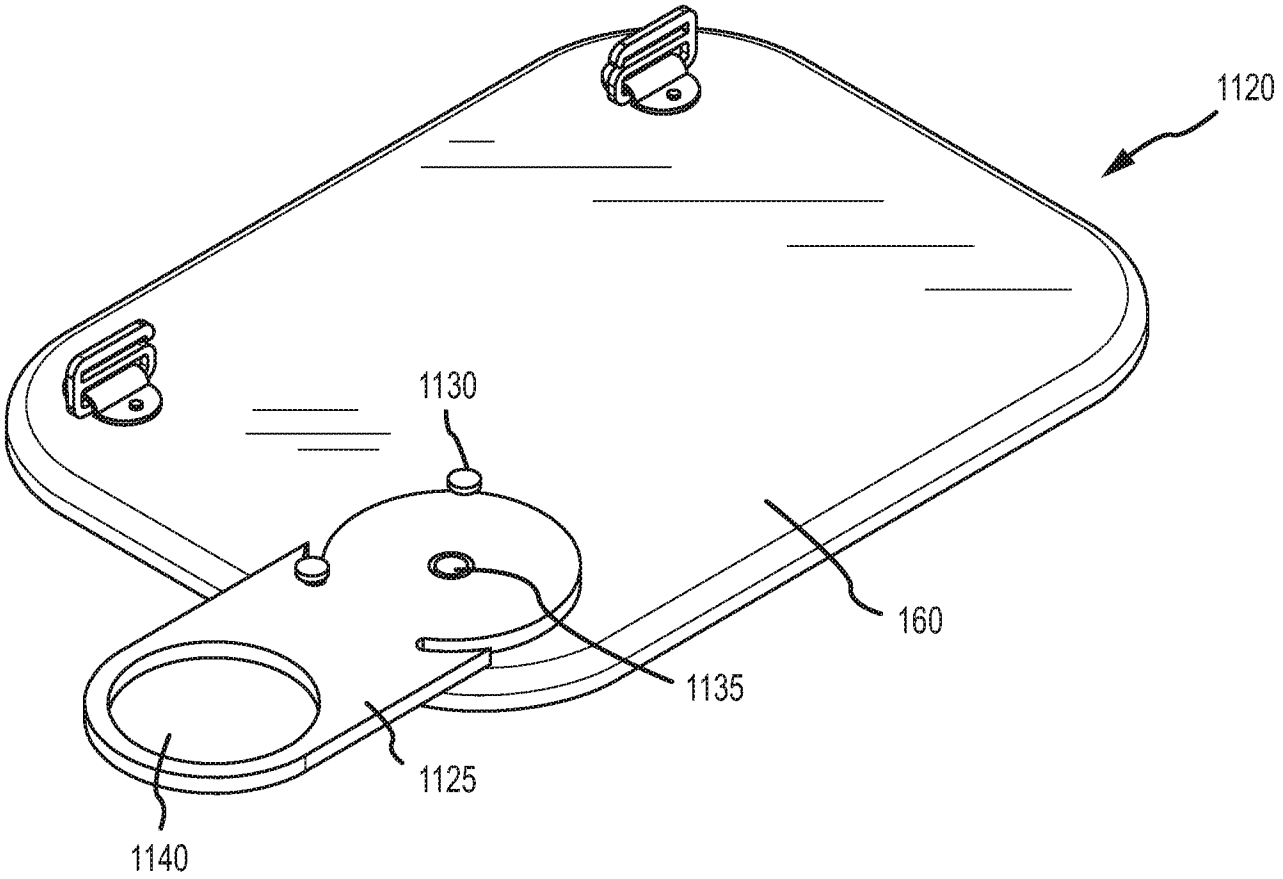
FIG. 35 shows another bottom perspective view of the table shown in FIG. 34.
Figure 36:
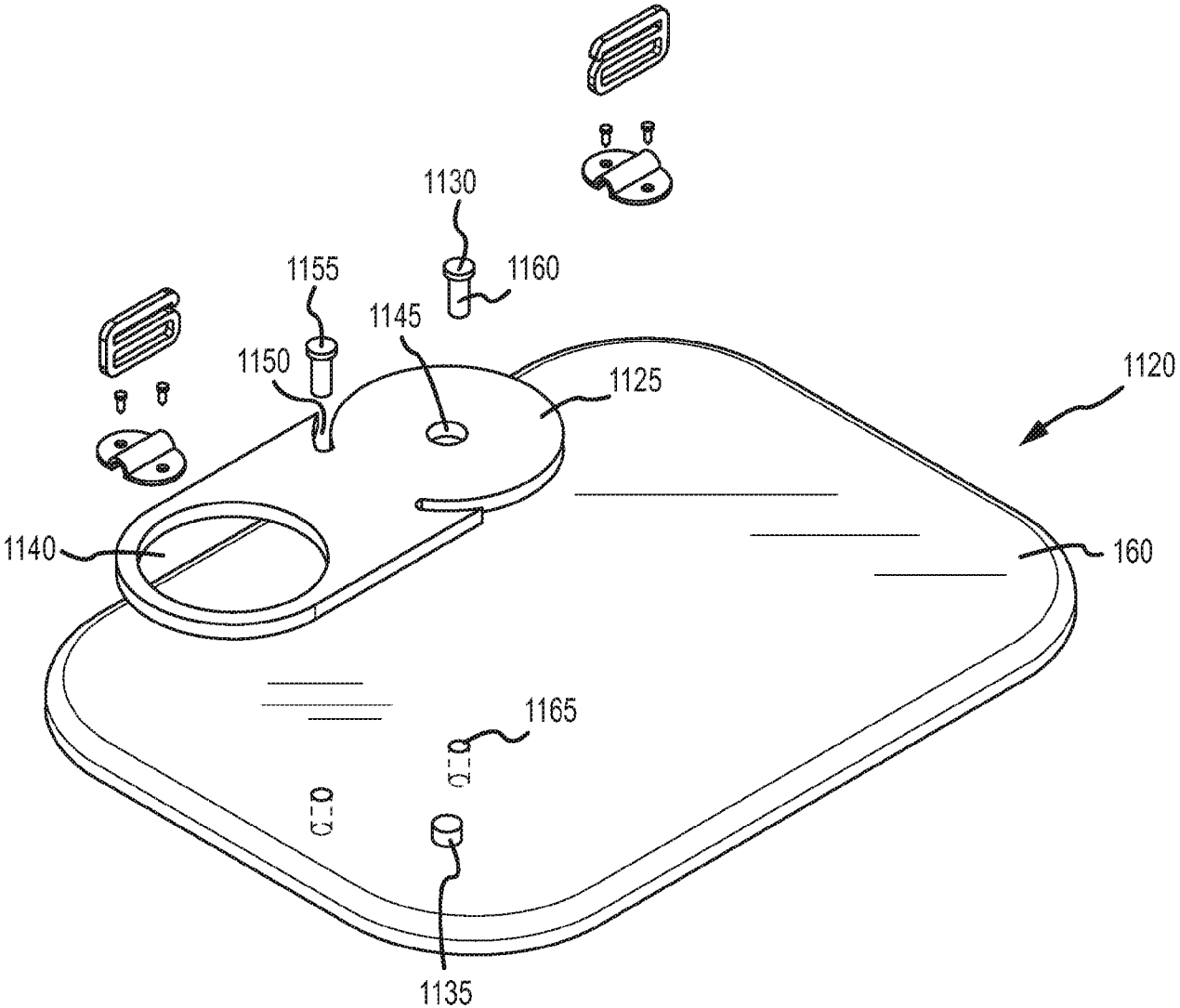
FIG. 36 shows an exploded perspective view of the table shown in FIG. 34.

FIGS. 34-36 show an eleventh version of the table 1120. The eleventh version of the table 1120 is similar to the seventh version of the table 720 in most respects. For example, like the seventh version of the table 720, the eleventh version of the table 1120 includes a cup holder member 1125 that positioned underneath the table 1120 and may be selectively moved between storage and operational positions. However, the eleventh version differs from the seventh version of the table in that the cup holder member 1125 is selectively pivoted rather than selectively slid to move it between the storage and operational positions.

With reference to FIGS. 34-36, the eleventh version of the table 1120 may include a container support assembly. The container support assembly may include the cup holder member 1125, a pair of stop members 1130, and a pivot axle 1135. The cup holder member 1125 may include a generally elongated body that defines an aperture 1140 that is similar to the apertures for the other previously shown and described cup holder members, an elastomeric material positioned around a perimeter of the aperture 1140, and a pivot hole 1145. The pivot hole 1145 may be sized to receive the pivot axle 1135 therein. The pivot axle 1135, in turn, defines a pivot axis about which the cup holder member 1125 may be pivoted to selectively move the cup holder member 1125 between the storage and operational positions. The pivot axle 1135 may be integrally formed with the table, or the pivot axle 1135 may be a separate member that is joined to the lower surface of the table 1120.

The body of the cup holder member 1125 may further define a pair of generally arcuate or curved slots 1150. The slots 1150 may be positioned on opposite sides of the body and may be sized to receive at least one of the stop members 1130 therein. Each slot 1130 may further include an open end to allow for at least one of the stop members 1130 to be selectively positioned within and removed from the slot 1150 by pivoting the cup holder member 1125 about the pivot axis. Each stop member 1130 may further be configured so that the stop member 1130 may be engaged with a closed end of a respective slot 1150, where the closed end of the slot 1150 is distal its open end. This engagement limits an ability of a user to further pivot the cup holder member 1125 in a particular clockwise or counterclockwise direction depending upon the location of the slot 1150 relative to stop member 1130. Further, the slots 1150 and the stop members 1130 may be further configured so that when a closed end of a slot 1150 engages a respective stop member 1130, the cup holder member 1125 is located in either a preferred storage position or a preferred operational position. In such a configuration, such an engagement provides an indication to the user of when the cup holder member 1125 is positioned in the preferred operational or storage positions.

Each stop member 1130 may include a head portion 1155 that may be used to keep to cup holder member 1125 secured to the table 1120 and a shaft portion 1160 for joining the stop member 1130 to the table 1120. To secure the cup holder member 1125 to the table 1120, the cup holder member 1125 may be positioned between the head portion 1155 of each stop member 1130 and the bottom surface 160 of the table 1120. Such a configuration may effectively sandwich the cup holder member 1125 between the stop members 1130 and the table 1120, thus helping to keep the cup holder member 1125 secured to the table 1120. The shaft portion 1160 of each stop member 1130 may be joined to the table 1120 using any suitable connection method, including mechanical fastening, adhering, or welding.

In some embodiments, two stop member holes 1165 or the like may be defined in the bottom surface 160 of the table 1120 for receiving at least an end portion of each respective stop member 1130 therein. Receipt of an end portion of each stop member 1130 in a respective stop member hole 1165 may facilitate joining each stop member 1130 to the table 1120. For example, the end portions of the stop members 1130 and/or their respective stop member holes 1165 may be threaded to allow for a threaded mechanical type connection to be utilized for joining each stop member 1130 to the table 1120. As another example, an adhesive, such as glue or the like, may be placed in each stop member hole 1165 to facilitate bonding or adhering each stop member 1130 to the table 1120. The foregoing examples are merely illustrative of some ways in which including stop member holes 1165 in the table 1120 may facilitate joining the stop members 1130 to the table 1120. As such, these examples are not intended to be limiting nor are intended to imply or require that the stop members 1130 must be joined to the table 1120 using a particular connection system.

Figure 37:
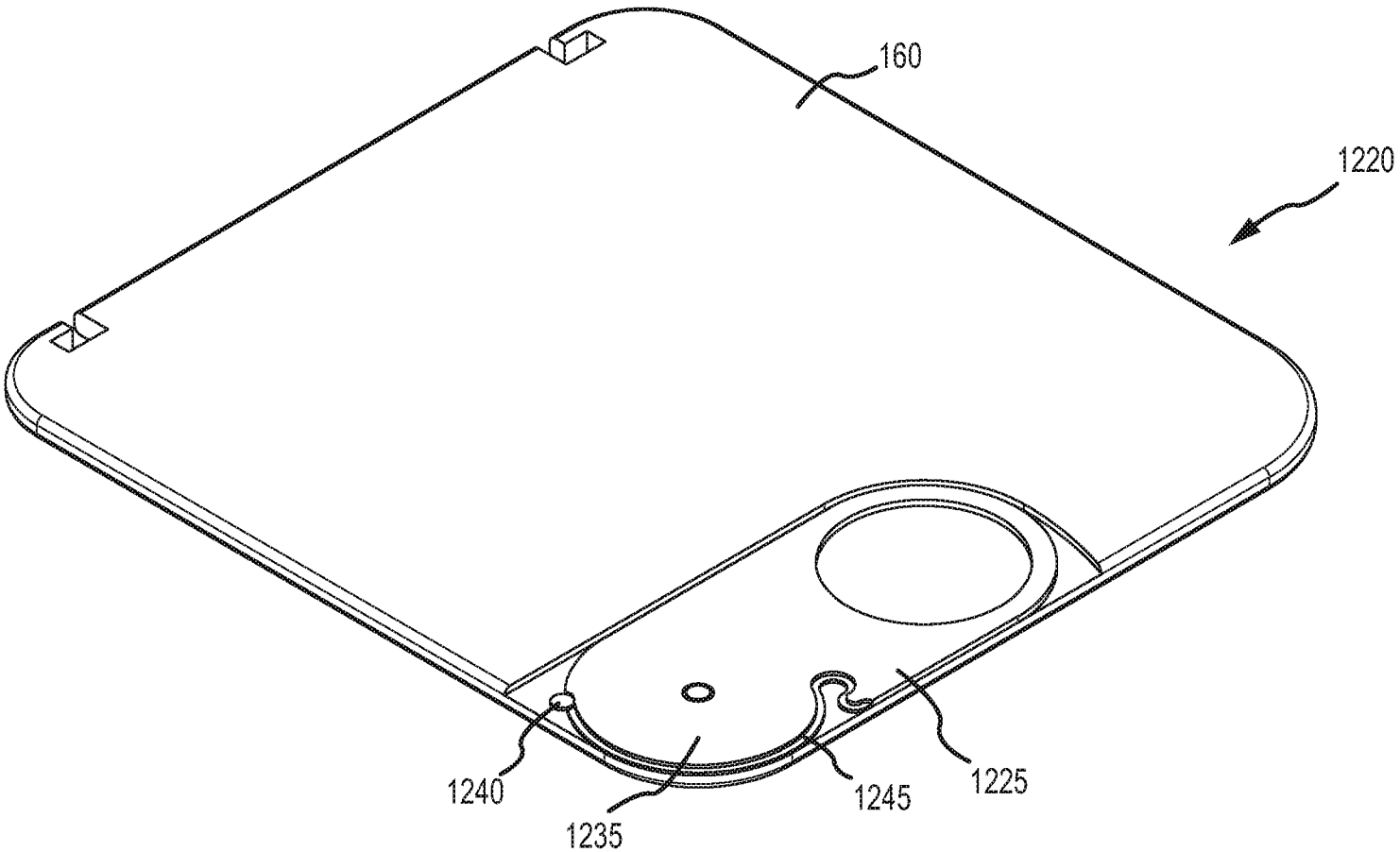
FIG. 37 shows a bottom perspective view of a twelfth version of the table.
Figure 38:
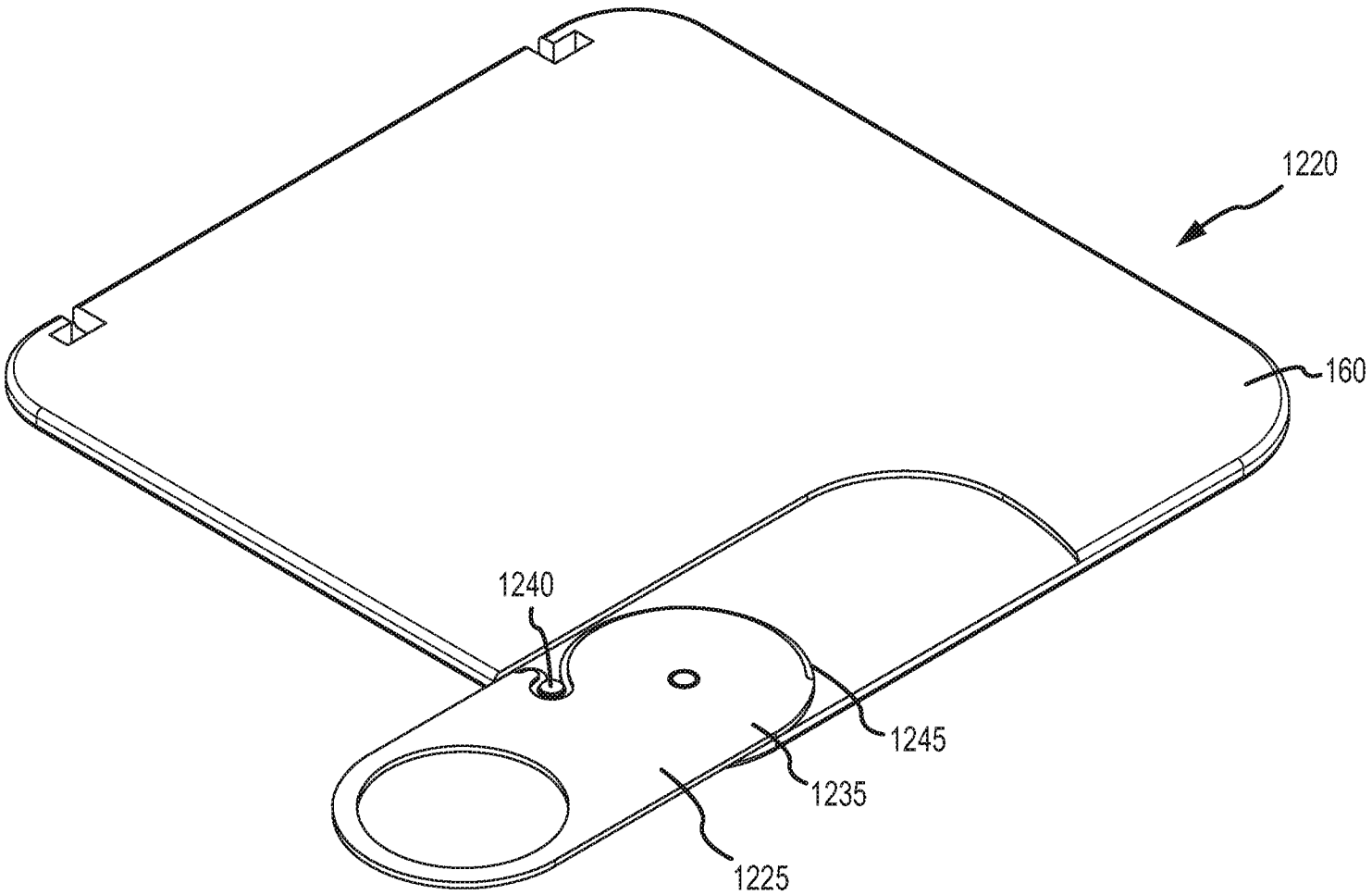
FIG. 38 shows another bottom perspective view of the table shown in FIG. 37.
Figure 39:
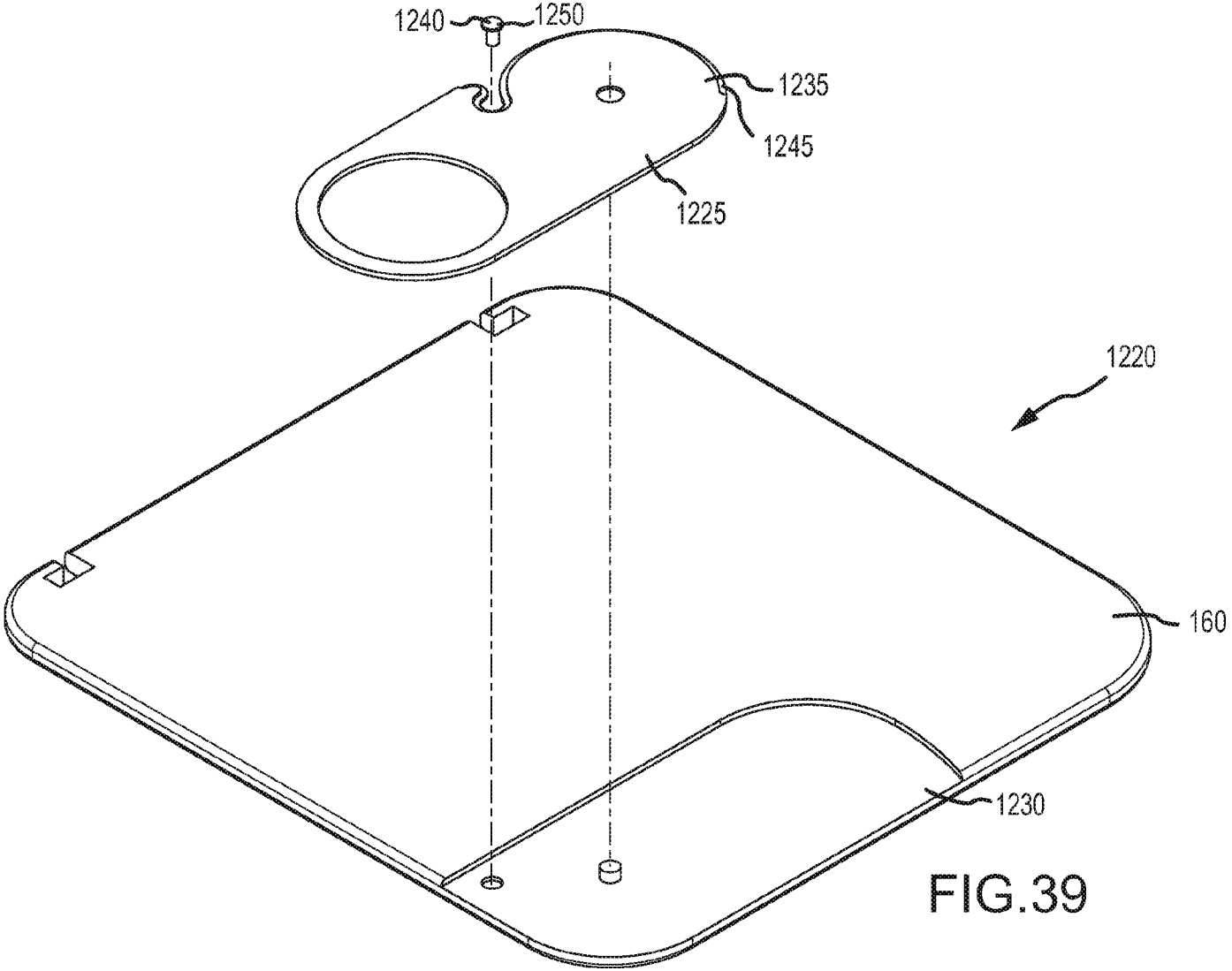
FIG. 39 show an exploded perspective view of the table shown in FIG. 37.

FIGS. 37-39 show a twelfth version of the table 1220. Like the eleventh version of the table 1120, the twelfth version of the table 1220 includes a pivoting cup holder member 1225. However, the twelfth version of the table 1220 differs from the eleventh version in that the table 1220 includes a cup holder member recess 1230. This cup holder member recess 1230 allows an outward facing surface 1235 of the cup holder member 1220 to be flush with the bottom surface 160 of the table 1220. The cup holder member recess 1230 also allows for a single stop member 1240 to be used rather than two stop members since the cup holder member recess 1230 provides for a stoppage of the pivoting movement of the cup holder member 1225 from its operational position to its storage position. Additionally, the cup holder member 1225 may include a groove 1245 formed along its curved end portion. The groove 1245 may be sized to receive a part of a head portion 1250 of the stop member 1240 therein, thus allowing the outer facing surface of the stop member 1240 to be substantially flush with the outer facing surface 1235 of the cup holder member 1225. As with the eleventh version of the table 1120, the cup holder member 1225 for the twelfth version of the table 1220 may be positioned to be sandwiched between the head portion 1250 of the stop member 1240 and the bottom surface 160 of the table 1220 to help secure the cup holder member 1225 to the table 1220.

Figure 40:
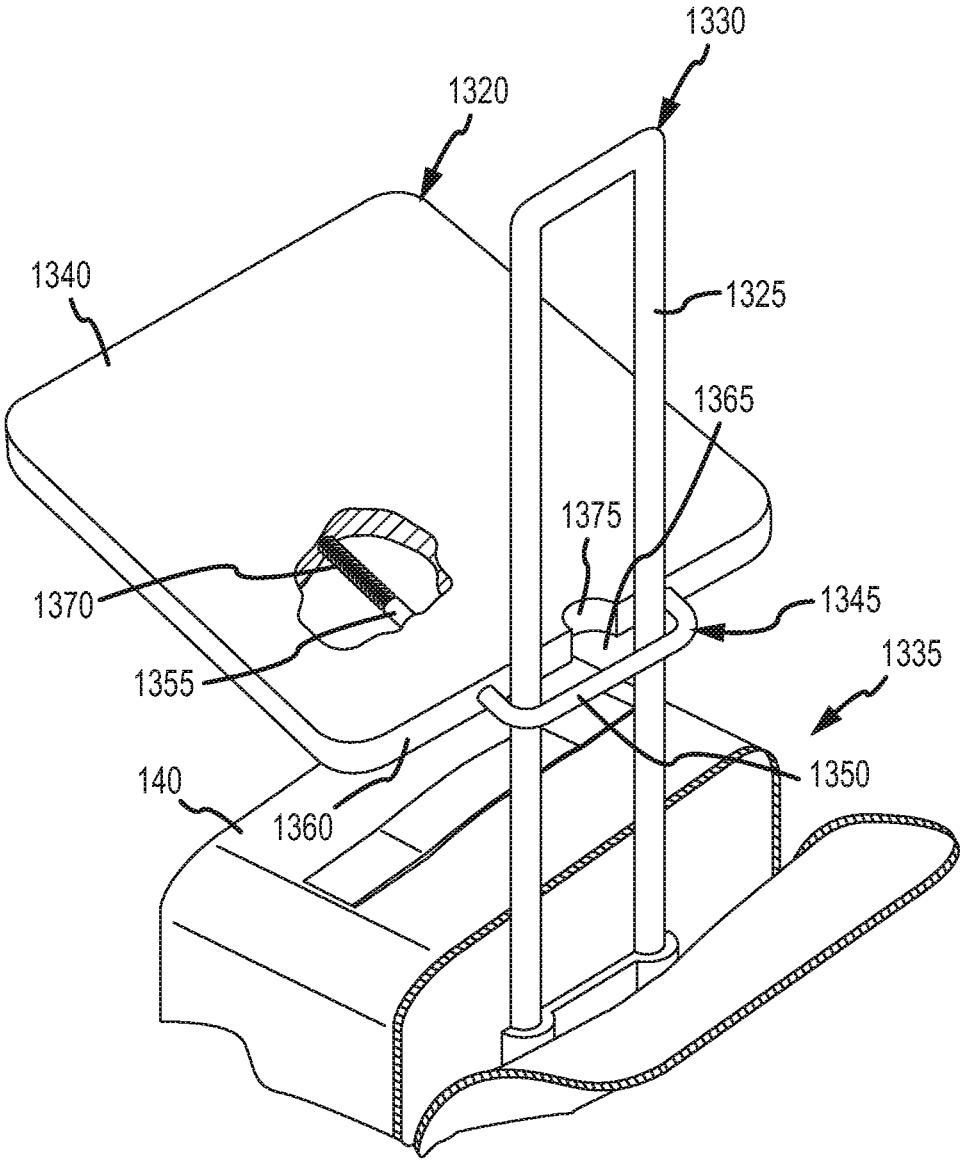
FIG. 40 shows a partial schematic perspective view of a thirteenth version of the table.
Figure 41:
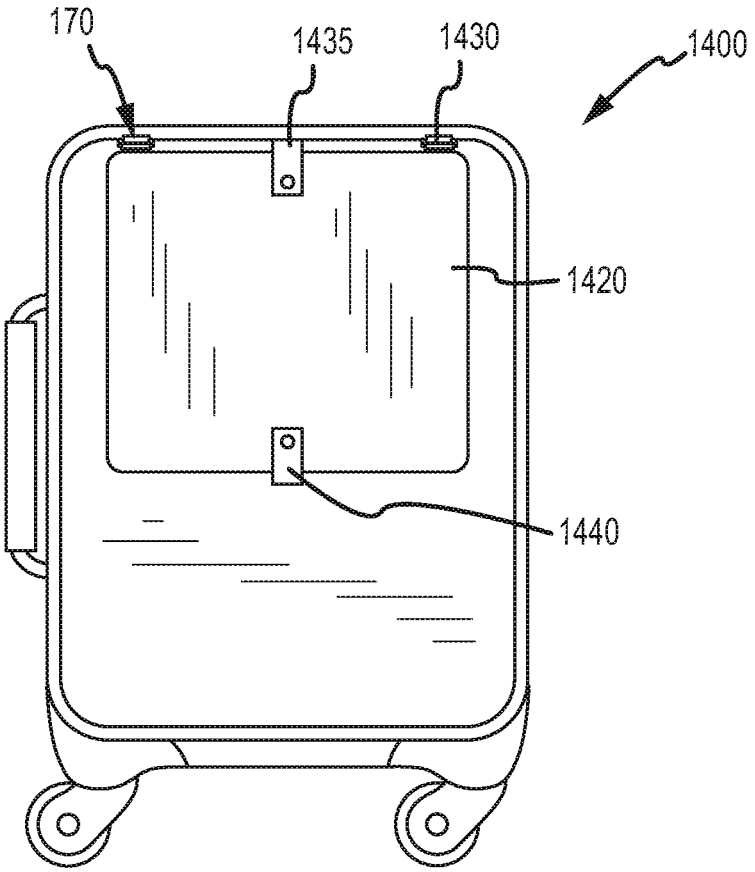
FIG. 41 shows a front schematic elevation view of a suitcase showing a fourteen version of the table.
Figure 42:
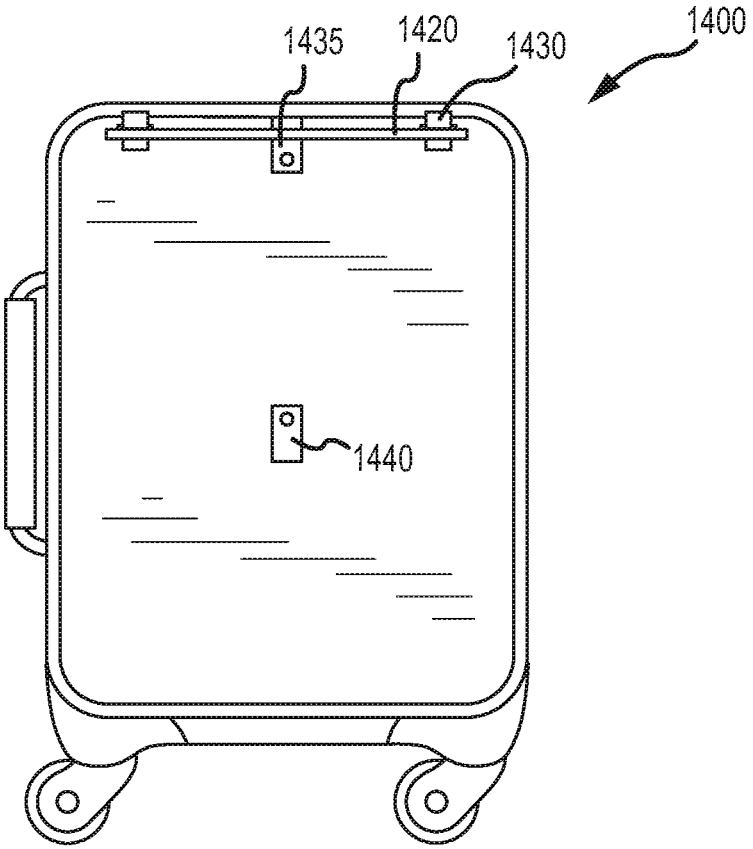
FIG. 42 shows another front schematic elevation view of the suitcase shown in FIG. 41.

FIG. 40 shows a thirteenth version of the table 1320. In this version, the table 1320 may be joined to the poles 1325 of a telescoping handle 1330, which may function in a manner similar to the guides. In particular, the table 1320 may be selectively slid along the poles 1325 to position the table 1320 into an operational position on the upper surface 140 of the suitcase 1335. Similarly, like the other tables, the thirteenth table 1320 provides a working or other relatively flat surface for a user that may be supported by the upper surface 140 of the suitcase 1335.

With continued reference to FIG. 40, the table 1320 may include a generally planar main body 1340 that includes a predetermined thickness. A connection assembly may include a first connector 1345 that may be joined to the table 1320. The first connector 1345 may include a base portion 1350 and a pair of leg portions 1355 that extend away from the base portion 1350 in a direction that is generally transverse to a longitudinal axis of the base portion 1350. Each leg portion 1355 may be joined the base portion 1350 at a respective end segment of the base portion 1350. Collectively, the base portion 1350 and the leg portions 1355 may define a generally U-shaped object.

The table 1320 may further include a pair of sliding spaces or the like that extend from an edge 1360 of the table 1320 towards the center of the main body 1340 of the table 1320. Each sliding space may be sized to receive at least a portion of a respective leg portion 1355 of the first connector 1345 therein. In some embodiments, the sliding spaces and the leg portions 1355 may be generally cylindrical. In other embodiments, the sliding spaces and the leg portions 1355 may be any other desired shape that allows the leg portions 1355 to be selectively slid within their respective sliding space. Selectively sliding the leg portions 1355 within their respective sliding space increases or decreases the segment of each leg portion 1355 received within its respective sliding space. This, in turn, increases or decreases the length of each leg portion 1355 that extends outside of the table 1320, which correspondingly increases or decreases a telescoping handle receiving area 1365 defined by the edge 1360 of the table 1320 and the first connector 1345. This ability to selectively change the size of the telescoping handle area 1365 allows the table 1320 to be used with a wide variety of differently sized telescoping handles 1330. Further, in some embodiments, the length of the base portion 1350 of the first connector 1345 may be selected to be at least as long as the greatest anticipated spacing apart of the poles 1325 of the telescoping handle 1330 to further increase the number of differently sized telescoping handles 1330 that may be selectively joined to the table 1320.

The connection assembly may further include biasing members 1370, such as springs or the like. Each biasing member 1370 may be joined to a respective leg portion 1355 of the first connector 1345 at a free end of the leg portion 1355. Further, each biasing member 1370 may be positioned within one of the sliding spaces and may be configured to draw its respective leg portion 1355 into the sliding space by a predetermined amount. In other words, the biasing members 1370 may be configured to bias the first connector 1345 to a position that results in the telescoping handle area 1365 being a predetermined minimum size. In some embodiments, this predetermined minimum size may be the minimal area required for a user to insert at least some of the user's fingers into the space defined between the base portion 1350 of the first connector 1345 and the abutting edge 1360 of the table 1320. In other embodiments, the predetermined minimum size may be approximately zero such that the leg portions 1355 are fully, or almost fully, received within their respective sliding spaces and the base portion 1350 of the first connector 1345 contacts, or almost contacts, the edge 1360 of the table 1320. In these embodiments, a cut-out 1375 or the like, such as shown in FIG. 40, may be defined along the edge 1360 of the table 1320 to allow a user to insert at least some of the user's fingers between the table 1320 and the base portion 1350 of the first connector 1345. In yet other embodiments, the predetermined minimum size may be selected so that the distance between the edge 1360 of the table 1320 and the base portion 1350 of the first connector 1345 is less than the smallest anticipated diameter or cross-section, as viewed along the length, of the poles 1325. In these embodiments, the cut-off 1375 may also be provided if the distance between the edge 1360 of the table 1320 and the base portion 1350 of the first connector 1345 is insufficient to allow a user to insert at least some of the user's fingers between the edge 1360 of the table 1320 and the base portion 1350 of the first connector 1345.

In operation, the telescoping handle 1330 of a suitcase 1335 may be extended at least a sufficient amount so that at least a portion of the pole or poles 1325 for the telescoping handle 1330 extend above the upper surface 140 of the suitcase 1335. A user may then pull on the first connector 1345 to increase the size of the telescoping handle area 1365 to be sufficiently large so that the user may insert the telescoping handle 1330 through the telescoping handle area 1365. The user may then slide or otherwise move the table 1320 downward along the pole or poles 1325 of the telescoping handle 1330 until a lower surface of the table 1320 engages the upper surface 140 of the suitcase 1335. The user can then release the first connector 1345. Once released, the biasing members 1370 reduce the size of the telescoping handle area 1365 by pulling the leg portions 1355 back into their respective sliding spaces. The biasing members 1370 may continue to reduce the size of the telescoping handle area 1365 until the edge 1360 of the table 1320 and the base portion 1350 of the first connector 1345 engage the poles 1325. This engagement of the table's edge 1360 and the base portion 1350 of the first connector 1345 joins or otherwise secures the table 1320 to the telescoping handle 1330. To enhance this securing of the table 1320 to the telescoping handle 1330, the edge 1360 of the table 1320, the base portion 1350 of the first connector 1345, or both may be coated with an elastomer, such as rubber or the like, or other suitable material that increases the frictional resistance to movement, especially lateral or sideways movement, of the telescoping handle poles 1325 relative to the table 1320 and the first connector 1345. To disconnect the table 1320 from the suitcase 1335, a user may pull on the first connector 1345 to increase the size of the telescoping handle area 1365 to be sufficiently large so that the user may slide the table 1320 upwards along the poles 1325 of the telescoping handle 1330 until the telescoping handle 1330 is no longer positioned within the telescoping handle area 1365.

In some embodiments, the table 1320 may be sized to be placed in a pocket or other enclosed space defined by the suitcase 1335. In other embodiments, the table 1320 be sized and otherwise configured to be stored on the exterior of the suitcase 1335. In these embodiments, appropriate support mechanisms, such as the support mechanisms shown in other versions of the suitcase, may be formed on the suitcase 1335 to facilitate joining the table 1320 to the suitcase 1335.

With continued reference to FIG. 40, in some embodiments, the telescoping handle 1330 may be positioned within pocket or other area that may be selectively closed. In such embodiments, the pocket may be used to keep the telescoping handle 1330 from being visible when it is positioned in its retracted position. However, in other embodiments, the telescoping handle 1330 may not be positioned within a pocket of other enclosed space. In other words, the table 1320 may be used any suitable telescoping handle 1330 regardless of whether or not the telescoping handle 1330 is positioned within a pocket or other enclosed space. Additionally, while two poles 1325 are shown for the telescoping handle 1330, the table 1320 may be joined to telescoping handles 1330 that have a single pole or more than two poles.

Figure 43:
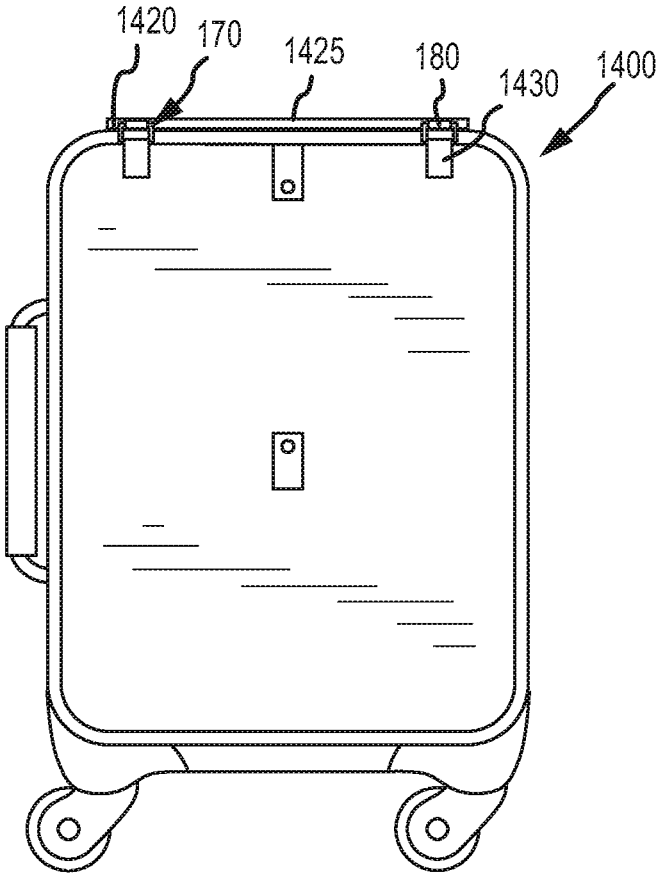
FIG. 43 shows yet another front schematic elevation view of the suitcase shown in FIG. 41.
Figure 44:
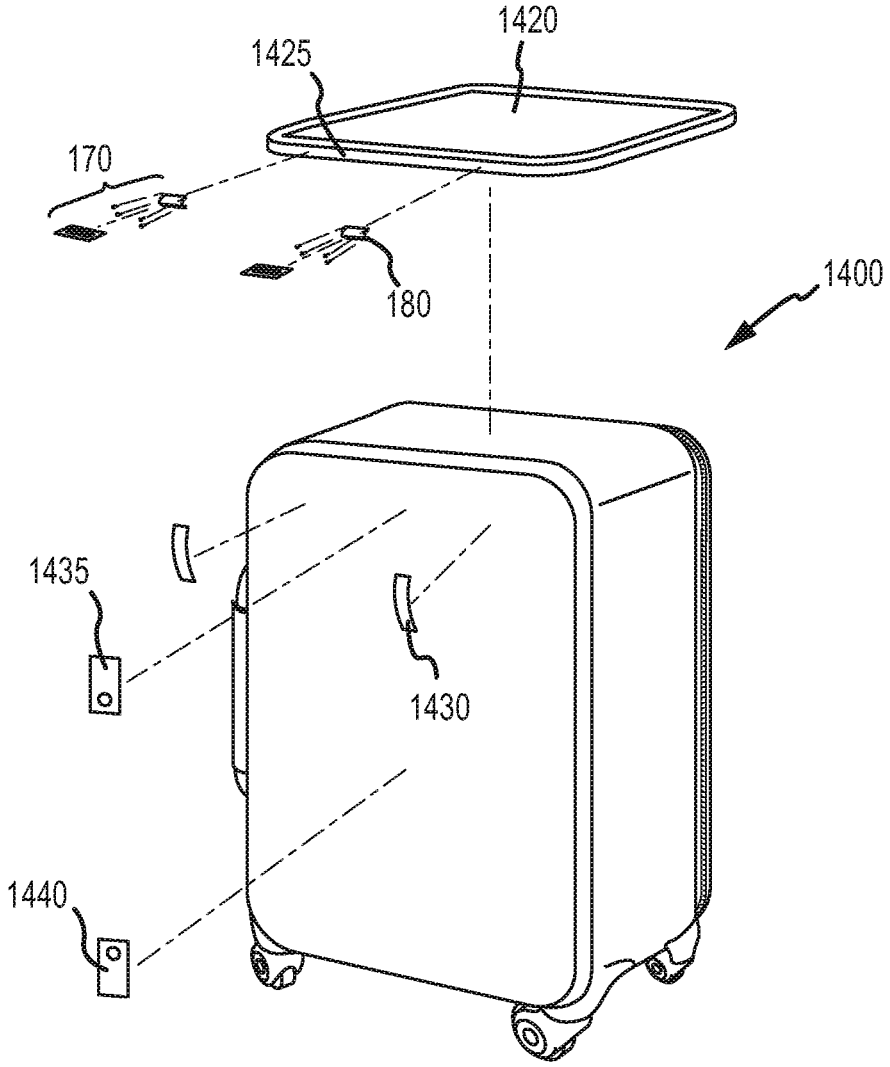
FIG. 44 shows a front schematic exploded perspective view of the suitcase shown in FIG. 41.

FIGS. 41-44 show a suitcase 1400 with a fourteenth version of the table 1420. In this embodiment, the table 1420 may be stored on the exterior of the suitcase 1400. Further, the fourteenth table 1420 may be generally similar to the first version of the table 120. In particular, the table 1420 may be similar to the first table 120 and a similar connection assembly 170 may be used. However, the connection assembly 170 for the fourteenth table 1420 may differ from the connection assembly of the first table 120 in that the second connector 180 may be joined to an edge 1425 of the table 1420 rather than to the lower surface of the table 1420. Further, rather than joining the table 1420 to elongated members that function as guides, the fourteenth table 1420 may be joined to straps 1430 or other suitable structures that form fixed loops or that in conjunction with an outer surface of the suitcase define fixed loop-like structures. Yet further, rather the sliding the table along a guide, the fourteenth table 1420 may be simply pivoted or otherwise rotated relative to the suitcase 1400 between its storage position (FIG. 41) and its operational position (FIG. 43).

With continued reference to FIGS. 41-44, support mechanisms 1435, 1440 may be positioned at the top and bottom edges of the fourteenth table 1420. Each support mechanism 1435, 1440 may be similar to the support mechanism shown in FIG. 16 and described in more detail above, or may take the form of any other suitable support mechanism, including, but not limited to, the support mechanism shown in FIG. 15. Yet further, if desired, the top or bottom support mechanisms 1435, 1440 may be omitted. Generally, however, it may be preferable to keep the bottom support mechanism 1435 rather than the top support mechanism 1440 in this embodiment since the connector assembly 170 may generally keep the top portion of the table secured to the suitcase 1400 in the absence of a top support mechanism 1435.

While the tables are described as used with a suitcase, the tables could be used with any type of luggage or with backpacks or other bags. Further, while the first connectors in the various versions of the tables are shown as joined to lower planar surfaces of their respective tables, any of the first connectors could be joined to a perimeter edge of its respective table (i.e., on an edge that defines the thickness of the table).

All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A suitcase, comprising:

a plurality of panels defining a main enclosed space, the plurality of panels comprising a front panel, a back panel, a top panel, and a bottom panel;

a telescoping handle positioned proximate the back panel;

a plurality of wheels;

a first closure mechanism positioned proximate the front panel for reversibly allowing access to the main enclosed space;

the front panel at least partially defining a pocket defining a secondary enclosed space;

a substantially planar object sized for receipt within the pocket;

at least one elongated flexible guide joined to a substantial portion of the pocket;

at least one connection assembly joining the substantially planar object to the at least one elongated flexible guide, the at least one connection assembly and the at least elongated flexible one guide configured to allow the at least one connection assembly to move along the elongated flexible guide; and the at least one connection assembly configured to allow the substantially planar object to pivot relative to an outer surface of the suitcase.

2. The suitcase of claim 1, wherein the substantially planar object comprises a table.

3. The suitcase of claim 2, wherein the table includes a primary body, and the primary body includes a first substantially planar surface and a second substantially planar surface positioned a predetermined distance from the first substantially planar surface.

4. The suitcase of claim 2, wherein the table includes a hole sized to receive a container.

5. The suitcase of claim 4, further comprising a container support joined to the table proximate the hole, and the container support selectively movable relative to the table to two or more positions.

6. The suitcase of claim 5, wherein when the container support is located at one of the two or more positions, the container support supports a container received within the hole.

7. The suitcase of claim 2, further comprising a cup holder member movably associated with table and configured to be selectively moved relative to the table between storage and operational positions, and the cup holder member including an aperture sized to receive a container.

8. The suitcase of claim 7, wherein the cup holder member may be selectively moved between the storage and operational positions by selectively sliding or pivoting the cup holder member relative to the table.

9. The suitcase of claim 8, wherein the table defines a cavity sized to receive the cup holder member therein.

10. The suitcase of claim 2, wherein the table includes a first body and a second body, and the first body includes a plurality of sidewalls defining a honeycomb-like structure.

11. The suitcase of claim 1, wherein the at least one elongated flexible guide comprises two elongated flexible guides spaced apart from each other a predetermined distance.

12. The suitcase of claim 11, the suitcase further including a first outer surface configured to support the substantially planar object.

13. The suitcase of claim 12, wherein at least one of the two elongated flexible guides is joined to the suitcase proximate the first outer surface of the suitcase.

14. The suitcase of claim 12, wherein at least one of the two elongated flexible guides extends from the first outer surface towards a second outer surface of the suitcase that is distal the first outer surface.

15. The suitcase of claim 12, wherein at least one of the two elongated flexible guides is joined to the suitcase at an end portion of said at least one of the two elongated flexible guides that is distal from the first outer surface of the suitcase.

16. The suitcase of claim 1, wherein the at least one connection assembly includes a first connector and a second connector, the second connector is joined to the substantially planar object, the second connecter and the substantially planar object define a hole, and at least a portion of the first connector is positioned within the hole.

17. The suitcase of claim 16, wherein the first connector defines a second hole, and at least a portion of one of the at least one elongated flexible guides is positioned in the second hole.

18. The suitcase of claim 16, wherein the first connector comprises either a rectangular ring or a D-ring.

19. The suitcase of claim 16, wherein the first connector comprises a body defining a hole and an open-ended slot.

20. The suitcase of claim 19, wherein at least a portion of one of the at least one elongated flexible guide is positioned in the open-ended slot.

21. The suitcase of claim 1, wherein the plurality of wheels includes four spinner wheel assemblies.

22. The suitcase of claim 1, wherein the substantially planar object has a maximum surface area, the top panel has a maximum surface area, and the maximum surface area of the substantially planar object is greater than the maximum surface area of the top panel.

23. The suitcase of claim 1, wherein the substantially planar object includes a cantilevered portion extending beyond the back panel of the suitcase.

24. The suitcase of claim 23, wherein the cantilevered portion is one-third the length of the substantially planar object.

25. The suitcase of claim 1, further comprising a second closure mechanism for reversibly allowing access to the pocket, the second closure mechanism positioned at least partially between the first closure mechanism and the front panel.

26. A suitcase, comprising:

a plurality of panels defining a main enclosed space, the plurality of panels comprising a front panel, a back panel, a top panel, and a bottom panel;

a first closure mechanism positioned proximate the front panel for reversibly allowing access to the main enclosed space;

the front panel at least partially defining a pocket defining a secondary enclosed space;

a substantially planar object sized for receipt in the pocket;

at least one elongated flexible guide joined to a substantial portion of the pocket;

at least one connection assembly joining the substantially planar object to the at least one elongated flexible guide, the at least one connection assembly and the at least one elongated flexible guide configured to allow the at least one connection assembly to move along the elongated flexible guide;

the at least one connection assembly configured to allow the substantially planar object to pivot relative to an outer surface of the suitcase; and a support mechanism joined to the pocket, the support mechanism configured to maintain the substantially planar object in a desired position.

27. The suitcase of claim 26, wherein the support mechanism comprises an elastic strap.

28. The suitcase of claim 26, wherein the support mechanism comprises a strap including a component of a fastener mechanism, and a corresponding component of the fastener mechanism is joined to the substantially planar object.

29. The suitcase of claim 28, wherein the fastener mechanism is selected from one the following: a Velcro fastener or a snap fastener.

30. The suitcase of claim 26, wherein the substantially planar object comprises a table.

31. The suitcase of claim 30, wherein the table includes a primary body, and the primary body includes a first substantially planar surface and a second substantially planar surface positioned a predetermined distance from the first substantially planar surface.

32. The suitcase of claim 30, wherein the table includes a hole sized to receive a container.

33. The suitcase of claim 32, further comprising a container support joined to the table proximate the hole, and the container support selectively movable relative to the table to two or more positions.

34. The suitcase of claim 33, wherein when the container support is located at one of the two or more positions, the container support supports a container received within the hole.

35. The suitcase of claim 30, further comprising a cup holder member movably associated with table and configured to be selectively moved relative to the table between storage and operational positions, and the cup holder member including an aperture sized to receive a container.

36. The suitcase of claim 35, wherein the cup holder member may be selectively moved between the storage and operational positions by selectively sliding or pivoting the cup holder member relative to the table.

37. The suitcase of claim 36, wherein the table defines a cavity sized to receive the cup holder member therein.

38. The suitcase of claim 30, wherein the table includes a first body and a second body, and the first body includes a plurality of sidewalls defining a honeycomb-like structure.

39. The suitcase of claim 26, wherein the at least one guide comprises two elongated flexible guides spaced apart from each other a predetermined distance.

40. A suitcase, comprising:

at least two panels defining a pocket on a front side of the suitcase;

a substantially planar object sized for receipt within a pocket, the substantially planar object including at least one slot;

at least one elongated flexible guide joined to at least one of the at least two panels and extending along a substantial portion of the pocket, the at least one guide received through the at least one slot; and the at least one slot and the at least one elongated flexible guide configured to allow the substantially planar object to slide along the at least one elongated flexible guide and to pivot relative to an outer surface of the suitcase.

41. The suitcase of claim 40, wherein the slot comprises an open-ended slot.

42. The suitcase of claim 40, wherein the substantially planar object comprises a table.

43. The suitcase of claim 42, wherein the table includes a primary body, and the primary body includes a first substantially planar surface and a second substantially planar surface positioned a predetermined distance from the first substantially planar surface.

44. The suitcase of claim 43, wherein the table includes a hole sized to receive a container.

45. The suitcase of claim 44, further comprising a container support joined to the table proximate the hole, and the container support selectively movable relative to the table to two or more positions.

46. The suitcase of claim 45, wherein when the container support is located at one of the two or more positions, the container support supports a container received within the hole.

47. The suitcase of claim 40, wherein the table includes a first body and a second body, and the first body includes a plurality of sidewalls defining a honeycomb-like structure.

48. The suitcase of claim 40, wherein the at least one guide comprises two elongated flexible guides spaced apart from each other a predetermined distance.

49. The suitcase of claim 48, the suitcase further including a first outer surface configured to support the substantially planar object.

50. The suitcase of claim 49, wherein at least one of the two elongated flexible guides is joined to the suitcase proximate the first outer surface of the suitcase.

51. The suitcase of claim 49, wherein at least one of the two elongated flexible guides extends from the first outer surface towards a second outer surface of the suitcase that is distal the first outer surface.

52. The suitcase of claim 49, wherein at least one of the two elongated flexible guides is joined to the suitcase at an end portion of the at least one of the elongated flexible guides that is distal from the first outer surface of the suitcase.

* * * * *